US008985694B2

(12) United States Patent
Fischer

(10) Patent No.: US 8,985,694 B2
(45) Date of Patent: Mar. 24, 2015

(54) ITEM OF SEATING FURNITURE AND FITTING THEREFOR

(71) Applicant: Matthias Fischer, Bratislava (SK)

(72) Inventor: Matthias Fischer, Bratislava (SK)

(73) Assignee: Kintec-Solution GmbH, Rietberg (DE)

( * ) Notice: Subject to any disclaimer, the term of this patent is extended or adjusted under 35 U.S.C. 154(b) by 0 days.

(21) Appl. No.: 13/800,802

(22) Filed: Mar. 13, 2013

(65) Prior Publication Data

US 2013/0257110 A1 Oct. 3, 2013

Related U.S. Application Data

(63) Continuation-in-part of application No. 13/564,293, filed on Aug. 1, 2012.

(30) Foreign Application Priority Data

Dec. 28, 2011 (EP) ..... 11195967

(51) Int. Cl.
*A47C 7/50* (2006.01)

(52) U.S. Cl.
CPC .. *A47C 7/50* (2013.01); *A47C 7/506* (2013.01)
USPC ..... 297/423.19

(58) Field of Classification Search
CPC .... A47C 1/034; A47C 1/0342; A47C 1/0345; A47C 7/503; A47C 7/506
USPC ..... 297/68, 83, 84, 88, 423.19, 423.2, 297/423.22, 423.26, 423.28
See application file for complete search history.

(56) References Cited

U.S. PATENT DOCUMENTS

| | | | | |
|---|---|---|---|---|
| 1,984,281 | A | 12/1934 | Poggendorf | |
| 2,484,803 | A | 10/1949 | Bell et al. | |
| 2,903,045 | A | 9/1959 | Viall | |
| 3,016,265 | A | 1/1962 | Cobb | |
| 3,068,047 | A | 12/1962 | Schliephacke | |
| 3,101,216 | A | 8/1963 | Schliephacke | |
| 3,429,612 | A | 2/1969 | Cobb | |
| 6,036,268 | A | 3/2000 | Larson | |
| 6,692,078 | B2 | 2/2004 | Pham et al. | |
| 7,080,887 | B2 * | 7/2006 | Tseng | 297/423.19 |

(Continued)

FOREIGN PATENT DOCUMENTS

| | | | |
|---|---|---|---|
| BE | 100 91 47 | A3 | 12/1996 |
| CN | 102871397 | A | 1/2013 |

(Continued)

OTHER PUBLICATIONS

European Search Report of European Patent Office issued in European Application No. 13159324.6-1653 dated Jul. 16, 2013 with English translation of category of cited documents (7 pages).

*Primary Examiner* — Philip Gabler
(74) *Attorney, Agent, or Firm* — Flynn, Thiel, Boutell & Tanis, P.C.

(57) ABSTRACT

An item of seating furniture including a base, a seat unit with a seat surface, and a leg unit moveable in relation to the seat unit and having a leg support surface. The leg unit is displaceable via a movement mechanism between a storage position wherein the leg support surface is arranged under the seat unit and a use position wherein the leg support surface is arranged in front of the seat unit. The movement mechanism has an intermediate support displaceable via a pivoting guide, wherein the pivoting guide has a pivot lever between the intermediate support and the seat unit or the base, and the movement mechanism has a guide with a sliding member. The sliding member is guided on the intermediate support, and the leg unit is attached to the sliding member.

26 Claims, 13 Drawing Sheets

(56) References Cited

U.S. PATENT DOCUMENTS

| | | | |
|---|---|---|---|
| 2008/0018157 | A1 | 1/2008 | Dewert |
| 2011/0043005 | A1 | 2/2011 | Fischer |
| 2013/0169018 | A1 | 7/2013 | Fischer |

FOREIGN PATENT DOCUMENTS

| | | | |
|---|---|---|---|
| DE | 28 47 875 | B1 | 10/1979 |
| DE | 3718645 | A1 | 3/1988 |
| DE | 295 01 078.9 | U1 | 4/1995 |
| DE | 200 00 633 | U1 | 4/2000 |
| DE | 10 2005 001 877 | A1 | 7/2006 |
| DE | 20 2008 000 302 | U1 | 4/2008 |
| DE | 10 2008 009 234 | A1 | 8/2009 |
| DE | 20 2010 002 820 | U1 | 8/2010 |
| EP | 2 609 834 | A1 | 7/2013 |

* cited by examiner

ITEM OF SEATING FURNITURE AND FITTING THEREFOR

CROSS-REFERENCE TO RELATED APPLICATION

This is a continuation-in-part of prior U.S. application Ser. No. 13/564 293, filed Aug. 1, 2012, the disclosure of which is hereby incorporated by reference herein.

FIELD OF THE INVENTION

The invention relates to an item of seating furniture having a base which is fixed in position during the correct use of the item of seating furniture, a seat unit with a seat surface, and a leg unit which is moveable in relation to the seat unit and has a leg support surface. In this case, the leg unit is displaceable by means of a movement mechanism between a storage position, in which the leg unit is arranged under the seat surface, and a use position, in which the leg unit is arranged in front of the seat surface.

BACKGROUND OF THE INVENTION

Diverse variant embodiments of items of seating furniture of the type in question are known from the prior art.

In order to obtain a sufficiently large leg support surface, there are variant embodiments which have a separately moveable end segment next to the leg unit. Provision is generally made in these configurations for the leg unit to be pivotable in relation to the seat unit, sometimes by means of double bracket mechanisms. The leg unit is then generally adjoined by a pivotable end segment. Examples of documents showing such or similar configurations with a leg segment and end segment include BE 100 91 47 A3, DE 10 2008 009 234 A1 and DE 3718645 C2. In the case of configurations which omit an end segment beyond the leg unit, it is more difficult to realize a sufficiently large leg support surface. For this purpose, DE 10 2005 001 877 A1 proposes a mechanism in which the leg unit is changeable in size. The latter can thereby be reduced in size during the transfer from the use position into the storage position below the seat surface. Only in this way is it possible to ensure a sufficient size of the leg support surface in the use position and a sufficient reduction in size of the leg unit in the pivoted storage position.

SUMMARY OF THE INVENTION

One aspect of the invention is to provide an item of seating furniture of the type in question which permits the displacement of the leg unit between the storage position and the use position by means of a simple mechanical configuration, wherein it is desired for the item of seating furniture also to be useable in the case of items of seating furniture with less space below the seat unit.

The effect which is intended to be achieved is for an item of seating furniture according to the invention to offer a sufficiently large leg support surface without an end segment which is displaceable in relation to the leg unit having to be arranged next to the latter for this purpose and without the leg unit having to be designed to be changeable in size per se.

According to the invention, this is achieved in that the movement mechanism is designed for transferring the leg unit from the storage position, in which the leg support surface is oriented substantially horizontally, into the use position, in which the leg support surface is likewise oriented substantially horizontally. In order to achieve this, the movement mechanism has an intermediate support which is displaceable in relation to the seat unit or the base by means of a pivoting guide, wherein the pivoting guide has at least one first pivot lever between the intermediate support and the seat unit or the base. Furthermore, an item of seating furniture according to the invention has a sliding guide with a sliding member, wherein the sliding member is guided in a translatory manner on the intermediate support, and wherein the leg unit is attached to the sliding member.

An item of seating furniture according to one aspect of the invention is an upholstered armchair or an upholstered sofa. In the case of a sofa, the latter may have a plurality of separately moveable leg units.

In conjunction with the detailed description below, the phrase "vertical direction" means a direction orthogonal to a deposition surface on which the item of furniture stands. The phrase "transverse direction" means a direction of extent which extends horizontally parallel to the front edge of the seat surface. The "longitudinal direction" of the furniture is a direction which is orthogonal to the transverse direction and vertical direction of the furniture. The phrases "at the front" and "at the rear" relate to the longitudinal direction of the furniture and refer to the perspective of the person sitting on the item of furniture and whose legs point forwards and whose back points rearwards.

Furthermore, in the context of the description using the phrase "first use state" reference is made to a state of the furniture in which the leg unit is in the storage position thereof. A "second use state" is a state in which the leg unit is arranged in its use position. In some embodiments according to the invention, there is a "third use state" in which, with the leg unit still being extended, the backrest is positioned more flatly in relation to the second use state.

The first use state allows a common seating position with the feet arranged on the ground. The second use state is also referred to as TV-position. With the feet being put up, the second use state still allows an essentially upright seating position. The third use state is intended to be a reclining position.

One important feature of the item of furniture according to the invention is that the latter is designed to displace the leg support substantially horizontally. A powerful pivoting movement, as is generally provided in the case of configurations from the prior art, is avoided. At least in the storage position and in the use position, the leg support has a substantially horizontal orientation, which should be understood as meaning that the leg support surface is in each case not pivoted by more than about 25° in relation to an imaginary horizontal plane. The leg unit is substantially horizontally oriented in this sense during the entire transfer operation from the storage position into the use position. This substantially consistent orientation of the leg unit makes it possible to use a comparatively large leg unit, since the length thereof, unlike in the case of known configurations, does not necessitate a comparatively high seat height on the item of seating furniture. The length of the seat support in the longitudinal direction can thus exceed the height of the clearance below the seat unit. As such, it is also possible to dispense with an end segment, which is displaceable separately in relation to the leg unit, for extending the leg support surface.

In order to be able to bring about the movement of the leg unit from the storage position into the use position, a movement mechanism is provided. The movement mechanism has an intermediate support which is provided pivotably on the seat unit or the base. The base here is formed by those parts of the item of seating furniture which, during the correct transfer of the leg unit from the use position into the storage position and vice versa, always remain in a fixed position with respect to an underlying surface on which the item of furniture stands. This underlying surface is also a framework on which the feet of the item of furniture are positioned.

In this context, "fixed in position" also means a pure rotatability. The base can thus be configured to be rotatable around a vertical axis by means of a rotary plate or a functionally-equivalent unit. A base is also considered to be fixed in position if it allows a luffing movement with respect to an underlying surface.

The seat unit can be moveable in relation to the base in the manner which will be explained below. The intermediate support may move along a circular path in relation to the seat unit or the base. The intermediate support itself serves for the translatory guidance of a sliding member which is thereby displaceable in the longitudinal direction of the furniture. The leg unit is therefore displaced in relation to the seat unit or the base by two sub-mechanisms acting in a cumulatively displacing manner. This achieves the desired extent by which the leg unit should be displaced between the storage position thereof and the use position thereof.

The use of two mechanisms in order to jointly achieve the desired displacement distance results in the two mechanisms, which are the pivoting guide and the sliding guide, each only having to carry out part of the desired displacement distance. It is therefore possible for even comparatively short levers to be used between the intermediate support, on the one hand, and the base or seat unit, on the other hand. The levers have a length between the coupling points thereof of not more than about 40 cm, and in one embodiment have a length of not more than about 30 cm.

The sliding guide which permits the movement of the leg unit in relation to the intermediate support permits displacement of the leg unit in relation to the intermediate support of at least about 10 cm, and in one embodiment permits displacement of at least about 15 cm. Within the context of the invention, a sliding guide should be understood as meaning guidance of the sliding member in relation to the intermediate support, the guidance being realized in particular by a slideway or by guide rollers or else by another guide suitable for producing translatory relative displacement.

Depending on the configuration of the item of seating furniture, the displacement of the sliding member in relation to the intermediate support not only serves to displace the leg unit forwards, but also, in an advantageous manner, permits a pivoting movement of the leg unit in relation to the intermediate support, which pivoting movement is also explained below.

In principle, it is conceivable, with regard to the connection of the intermediate support to the seat unit or the base, for the support as a whole to be fixedly connected to the first pivot lever, and therefore, with regard to the orientation thereof, to follow the pivoting movement. However, it is advantageous if the first pivot lever is coupled to the seat unit or the base so as to be pivotable firstly about a pivot axis and is coupled to the intermediate support so as to be pivotable secondly also about a second pivot axis. This makes it possible to prevent the intermediate support from pivoting to the same extent as is applicable for the pivot lever. The intermediate support can therefore be displaced by the pivoting guide, within the context of a substantially consistent horizontal orientation of the leg unit, without substantially having to change its orientation in the process.

In order, nevertheless, to permit a defined displacement of the intermediate support, a forced guidance arrangement is provided, by means of which each pivoting position of the first pivot lever in relation to the seat unit or in relation to the base is associated with a resultant pivoting position of the intermediate support in relation to the first pivot lever. The forced guidance arrangement of this type therefore leads to the desired certainty in the intermediate support movement. Such movement is of a type such that, during the transfer of the leg unit from the storage position into the use position, the intermediate support is not pivoted by more than about 20°. A configuration of the forced guidance arrangement, in which the pivoting guide has a second pivot lever which is coupled to the seat unit or to the base so as to be pivotable about a third pivot axis spaced apart from the first pivot axis, and also is coupled to the pivoting support so as to be pivotable about a fourth pivot axis spaced apart from the second pivot axis, has proven particularly advantageous. The pivoting guide is therefore designed as a double lever pivoting guide. By the pivot levers having an identical or substantially identical (+/− about 20%) length between the respective coupling points thereof, the substantially horizontal displacement of the intermediate support is achieved.

The particular feature which arises from the use of the pivoting guide between the base or seat unit, on the one hand, and intermediate support, on the other hand, and from the use of the sliding guide is the fact that the predominant portion of the intermediate support can always remain below the seat surface. This applies in particular to the coupling points of the first, and optionally also the second, pivot lever. These coupling points are arranged in such a manner that they remain completely to the rear of a front edge of the seat surface irrespective of the position of the intermediate support. The effect therefore achieved is that the intermediate support moves in relation to the seat surface or the base by means of a pivoting guide which can very readily be concealed from the user's sight. This is advantageous in particular if the abovementioned pivot levers are provided on the outside of the seat surface, with reference to the transverse direction. Mechanical components which extend on the left and right from the seat surface so far so as to be located in front of the front edge of the seat surface are considered to be aesthetically disadvantageous, and furthermore also form considerable opportunities for injury.

It is accordingly considered to be particularly advantageous if only mechanical components of the sliding guide are visible from the outside and from customary perspectives in the use position of the leg unit.

It is in principle conceivable for the sliding guide and the pivoting guide to be mechanically independent such that they can be influenced separately by the user. However, within the context of convenient handling, it is considered to be advantageous if the pivoting guide and the sliding guide are operatively coupled to each other such that, depending on the relative position of the intermediate support in relation to the seat unit or the base, a relative position, which is dependent thereon, of the sliding member with respect to the intermediate support is set.

Provision is accordingly made for the movement of the intermediate support in relation to the seat unit or the base along a path in the shape of a section of a circle indirectly also to cause the movement of the sliding member in relation to the intermediate support. In this case, the movement of the sliding member takes place in a substantially corresponding direction with the movement of the intermediate support. The intermediate support is therefore displaced forwards to a lesser extent in relation to the base or the seat unit and the leg unit is at the same time displaced forwards to a greater extent.

In order to obtain the abovementioned operative coupling between the pivoting guide and the sliding guide, it has proven particularly advantageous if this is brought about via a control lever which is coupled to the intermediate support, to the sliding member and to the base or the seat unit, or else to one of the pivot levers. In this case, this control lever is mounted on the intermediate support so as to be pivotable about a vertical or horizontal axis. However, this arrangement with a vertical or horizontal pivot axis of the control lever results in the coupling points thereof for interaction with the sliding member on the one hand, and the base, the seat unit or one of the pivot levers on the other hand, being realized along a circular arc shape, and therefore intermediate levers may be required here. The provision of an intermediate lever can also be necessary if the sliding member is guided in a translatory manner along a nonlinear path with respect to the intermediate support. A configuration with intermediate levers or a slideway, which can be provided instead, should also be considered as a coupling of the sliding member with regard to the control lever within the context of the above explanations. Such an intermediate lever between the control lever and the sliding member can be configured in quite a short length in case of a sliding member which also in the use position of the leg support extends as far as below the seating surface and it may only serve the purpose of balancing the rotational movement of the control lever and the translatory movement of the sliding member.

In other embodiments, the sliding member does not extend as far as below the seating surface in the use position of the leg support. This applies in particular to embodiments in which provision is made for a nonlinear translatory movement of the sliding member in relation to the intermediate support, in particular in relation to an extension of the intermediate support described further below. In such embodiments, the intermediate lever attached to the control lever and the sliding member can be larger. In such a case, the intermediate lever extends approximately parallel to the extension up to the sliding member arranged at the end of the extension.

The proposed control lever is pivoted by the relative movement of the intermediate support in relation to the seat unit or the base and transmits the pivoting movement to the sliding guide, as a result of which the sliding member is displaced in relation to the intermediate support.

In principle, it is possible to fasten the leg support to a distal end of the sliding member in such a manner that the leg support is no longer moveable in relation to the sliding member. However, in case an intermediate member is moveable relative to the intermediate support in a linear manner, a pivotable coupling of the leg support to the sliding member is of advantage.

This applies in particular to a development of the invention, in which provision is made for the extension already mentioned to be attached to the intermediate support and extend up to the leg support. In this case, the leg unit can include a pivoting mechanism, wherein the pivoting mechanism is designed for bringing about a pivoting of the leg unit in relation to the sliding member depending on the relative position of the sliding member with respect to the extension.

In this configuration, not only does the sliding member therefore extend as far as the leg support, but so too does an extension, which is part of the intermediate support or is connected fixedly thereto. Since, within the course of the transfer of the leg unit into the use position, a relative displacement of the sliding member in relation to the intermediate support takes place, a displacement of the sliding member in relation to the extension also takes place. According to this development, the relative movement is used in order to pivot the leg unit. This makes it possible to bring about a particularly ergonomic position of the leg unit in the use position. In particular, the pivoting mechanism makes it possible, moreover, to optimize the movement mechanism to the path of movement of the leg unit between the use position and the storage position, since a possible non-ideal orientation of the leg unit in the use position, which orientation arises during the optimization, can be corrected by the additional pivoting mechanism.

Furthermore, the extension can serve to improve the tilting stability of the leg unit.

Instead of a configuration having a sliding member which can be moved in a linear manner, which linear relative movement in relation to the extension leads to a pivoting of the leg unit by means of the pivoting mechanism, in an advantageous embodiment provision can be made so that the sliding member itself can be moveable along a nonlinear path in a translatory manner in relation to the intermediate support. Thus, the nonlinear path can in particular have a curved shape such that a movement of the sliding member in relation to the intermediate support to the front also causes a slight tilting of the sliding member in relation to the intermediate support. This can in particular be achieved by providing a roller guidance between the extension of the intermediate support and the sliding member which includes at least one slotted guide track and at least two guide sliders or guide rollers arranged in the slotted guide track.

In case of such a sliding member which can be moved in relation to the extension of the intermediate support in a nonlinear, translatory manner, provision is made so that the sliding member in the use position is merely under the leg support surface, but does not extend as far as under the seat surface. An operative coupling with the pivot movement of the intermediate support in relation to the base or the seat unit can be achieved by means of the aforementioned intermediate lever which extends essentially parallel to the extension of the intermediate support.

Since, according to the aforementioned developments, both the extension and the sliding member or the intermediate lever, respectively, extend between the seat unit and the leg unit and therefore, depending on the configuration of the item of seating furniture, are visible to the user in the use position of the leg unit, it is considered to be particularly advantageous if walls of the extension surround an interior space within which the sliding member or the intermediate lever connected to the sliding member, respectively, is moveably arranged. The user therefore cannot see the presence of two components which are moveable relative to each other. The sliding member or the intermediate lever connected to the sliding member, respectively, is concealed within the extension. In principle, a reverse arrangement is also conceivable, in which the sliding member defines an interior space within which the extension is arranged. In this case, the interior space does not have to be completely closed. However, it is considered to be advantageous within the context of stability if the extension is actually designed as a closed hollow profile within which the sliding member is moveable in a sliding manner or in a manner guided by rollers.

The extension and/or the sliding member or the intermediate lever, respectively, are arranged, with reference to a transverse direction of the item of furniture, in a central region which, at maximum, takes up about one third of the width of the seat surface. This results in an aesthetically advantageous configuration in which it is barely possible to see anything more than an inconspicuous tube between the seat unit and the leg unit from the outside.

The pivoting mechanism which is assigned to the leg unit has a pivot support which is pivotable about a fifth pivot axis, which is arranged in a fixed position with respect to the sliding member, and is provided in a fixed position with respect to the leg unit. The pivoting support therefore has the effect that the leg unit is pivotably moveable in relation to the sliding member only about a pivot axis which is fixed in position in relation to the sliding member and leg unit. In order to realize the pivoting movement, provision is made for the pivoting mechanism to have a slotted guide mechanism with a slotted guide track and a guide slider, via which the pivoting support is operatively connected to the extension. A relative movement of the extension in relation to the sliding member therefore results in the desired pivoting displacement of the leg unit in relation to the sliding member. The slotted guide mechanism permits a particularly flexible control here. The effect can thus be achieved, for example, that the pivoting movement of the leg unit in relation to the sliding member takes place only in a final phase during the transfer of the leg unit into the use position. The slotted guide mechanism includes two slotted guide tracks which are provided in two plates which are parallel to each other and are in turn spaced apart in the transverse direction of the item of furniture. By this means, a high degree of torsional rigidity of the leg unit is obtained. The slotted guide tracks in one embodiment are non-linear.

Furthermore, it is considered to be particularly advantageous if the seat unit is designed so as to be displaceable in relation to the base of the item of seating furniture, as has already been explained. In this case, the relative movement of the seat unit in relation to the base is operatively coupled to the relative movement of the pivoting support in relation to the seat unit. The user of the item of seating furniture according to the invention can therefore bring about the transfer of the leg unit from the storage position into the use position by displacement of the seat unit in relation to the base. The displacement of the seat unit forwards in relation to the base results in the leg unit being transferred into the use position.

In one configuration, the movement of a backrest unit of the furniture is operationally-coupled to the movement of the seat unit in relation to the base, so that the movement of the seat unit which leads to the transfer of the leg unit into the use position thereof, or a subsequent continued movement of the seat unit, leads to a pivoting of the backrest unit.

The item of furniture operates in the manner of a pair of scales. Movement of the seat unit downwards brings about a movement of the leg unit upwards. During the transfer of the leg unit between the storage position and the use position, use is therefore made of the potential energy of the unit being lowered in each case and of the body portion resting thereon in order to raise the other unit and the body portion resting thereon. The user, who remains sitting on the item of furniture, therefore only has to supply a small amount of mechanical energy by muscular force or else by an optionally provided motor for the electrical displacement.

It is advantageous if the moveability of the seat unit in relation to the base is provided by two displacement levers which are each coupled to the base or a displacement unit on the one side, respectively, and to the seat unit on the other side about pivot axes spaced apart from each other. The use of two displacement levers having pivot axes which are parallel to each other but are spaced apart from each other provides a structurally very simple possibility for obtaining the displacement of the seat unit in relation to the base or the displacement unit, respectively. The displacement levers are of differing length and/or oriented to be non-parallel, and therefore, during the course of the pivoting movement, the seat unit is also tilted. In the use position of the leg unit, a front edge of the seat surface is raised. Provision is made for the pivoting angles of the displacement levers between the base and seat unit always to be smaller than the pivoting angles of the pivot levers between the seat unit and intermediate support. The pivot levers pivot between the storage position of the leg support and the use position of the leg support by more than about 80° while the displacement levers pivot through less than about 60°.

In order to obtain a stable use position and/or a stable storage position of the leg unit, the following measures are expedient: if the leg unit is in the storage position thereof below the seat unit, at least one of the displacement levers or pivot levers is close to a dead center position or even in a position beyond dead center such that, in order to transfer the leg unit into the use position, initially a slight raising of the seat unit at least in the region of the displacement lever in the position beyond the dead center is required. As an alternative or in addition, an activating lever can be provided, the activating lever making it possible to leave the dead center position by means of a manually applied muscular force.

The above avoids the leg unit being inadvertently transferred into the use position. When the leg unit is in the use position thereof, at least one of the displacement levers, and in one embodiment both displacement levers, is or are in a position in which an angle between a connecting straight line, which connects the coupling points of the displacement lever on the one hand, and a horizontal plane on the other hand, is less than about 60°, and in one embodiment is less than about 50°. The shifting of the leg unit from the use position in the direction of the storage position thus requires a comparatively powerful application of force to the leg unit, the application customarily not being brought about inadvertently.

One advantageous embodiment of the item of seating furniture according to the invention includes the base and the seat unit being attached to one another by means of a displacement unit, the displacement unit being moveable in relation to the base and the seat unit being moveable in relation to the displacement unit.

The displacement unit serves the purpose of ensuring an additional displacement of the seat unit. Thus, the latter can not be displaced in a guided manner in relation to the base directly, but in relation to the displacement unit, which in turn can be displaced in relation to the base per se. As a result, the seat unit can be displaced in total very far between the two extreme positions thereof, which is in particular convenient in order to allow pivoting of the backrest of the item of furniture far down backwards, without interference.

In this case, it is of particular advantage when the displacement unit can be displaced forwards relative to the base along a movement path starting from a base position, the movement path being linear or almost linear. In this case, the linear movement can be achieved via a slotted guide system or a lever system.

An almost linear movement refers to a movement which between the starting position and the end position thereof has a deviation from a theoretical straight line extending between the starting position and the end position, which deviation is measured orthogonal to the straight line, that is at maximum about 20% of the distance between the starting position and the end position.

The displacement of the displacement unit in relation to the base is between about 13 cm and about 15 cm.

With regard to the movement path of the displacement unit, it is furthermore considered to be advantageous if the movement path has a slope to the front thereof. Thereby, a permanent force application of the displacement unit back into the base position thereof is achieved. If the displacement unit is displaced forwards along the movement path when transferring the item of furniture into the third use state thereof, the energy involved therefore is partially stored as potential energy. During the re-transfer into the second use state, the energy is available for supporting the transfer.

The aforementioned lever system for displacing the displacement unit in relation to the base is configured in such a way that it includes at least one movement lever, which movement lever is coupled to the displacement unit so as to be pivotable and which on its part is guided by means of at least two intermediate levers which are coupled to the base so as to be pivotable.

By means of such a lever system, despite the natural pivotability of such levers, an almost linear movement can be achieved. In particular, this is obtained by at least one of the movement levers being coupled to the base by means of a first and a second intermediate lever, with the following three distances being at least almost identical. Firstly, this is the distance between the pivot axis around which the first pivot lever is coupled to the movement lever and a pivot axis around which the movement lever is attached to the displacement unit so as to be pivotable. Furthermore, secondly, this is the distance between the aforementioned pivot axis around which the first intermediate lever is coupled to the movement lever and a pivot axis around which the movement lever is attached to the second intermediate lever so as to be pivotable. And, thirdly, this is the distance between the aforementioned pivot axis around which the first intermediate lever is coupled to the movement lever, and a pivot axis around which the first intermediate lever is attached to the base so as to be pivotable.

The three distances mentioned above together define the movement path along which the pivot axis of the movement lever and the displacement unit can be moved in relation to the base. By means of a deviation from one another by a maximum of about 20% (shortest distance in relation to longest distance), the desired almost linear movement is made possible.

The backrest unit can be pivoted around a backrest axis in relation to the seat unit, the backrest axis being displaceable together with the seat unit in relation to the base. In this case, a backrest guidance system is provided by means of which the backrest unit can be pivoted around the backrest axis depending on the relative position of the seat unit to the base and/or the relative position of the displacement unit to the base. The backrest guidance system leads to a predefined pivotability of the backrest. The position of the latter is defined by the pivot axis on the side of the seat unit, on the one hand. On the other hand, the backrest guidance system defines how far the backrest lowers if the pivot axis is displaced.

In one possible embodiment of such a backrest guidance system, the guidance of the backrest is effected by means of a slotted guide track and a roller or a slider inserted therein. In one configuration, in this case the slotted guide track is provided on the base fixed in position, while the roller or the slider is attached to the back unit.

Also possible is a configuration in which the backrest guidance system includes a control lever which is attached to the backrest unit eccentrically to the backrest axis which forms an operative coupling to the other movable parts of the furniture. In particular, the control lever can be attached to the backrest unit so as to be pivotable on the one side and on the other side be attached to the base or to one of the movement levers of the displacement unit so as to be pivotable.

In order to facilitate the use of the item of furniture, preferably a first and a second blocking system are provided, the first blocking system being configured to block a displacement of the displacement unit in relation to the base in the storage state of the leg unit, and the second blocking system being configured to block a displacement of the leg unit in relation to the seat unit in the third use state. As a result, when realizing both blocking systems, the user on the one hand is prevented from bringing the backrest into a reclining position without bringing the leg unit into the use position beforehand, and on the other hand, when starting from the reclining position, the user is prevented from displacing the leg unit in the direction of its storage position without first bringing the backrest back in the direction of its upright position.

This is achieved by the first and/or the second blocking system defining a maximum distance or a minimum distance between two points, one of which is displaced together with the backrest unit and the other of which is displaced together with the leg unit. A particularly advantageous system is one in which both blocking systems are commonly formed by two stops which bear against one another in both the first and the third use state, and thus cause the desired blocking effect. Particularly advantageous is the use of a bracket provided on the backrest so as to be pivotable, the bracket having a slot hole whose one end forms one of the stops, while the other stop is formed by a bolt in the slot hole.

It is furthermore considered to be advantageous if a spring device is provided on the item of seating furniture, the spring device in each case putting up a counterforce to a transfer of the leg unit from the use position in the direction of the storage position and/or to a transfer of the leg unit from the storage position in the direction of the use position. This increases the stability of the storage position and of the use position.

In order to obtain the effect of the use position and storage position being stabilized, it is advantageous if the spring device is arranged on subcomponents of the item of seating furniture between coupling points, wherein the coupling points are arranged in such a manner that, during the transfer of the leg support from the storage position into the use position, the coupling points are first of all spaced apart from each other and subsequently are drawn nearer to each other.

Therefore, leaving both of the use position and the storage position requires the supply of mechanical energy to the spring device. The invention furthermore relates to a fitting system for items of seating furniture, the fitting system being designed in such a manner that it provides the above-mentioned relative movement between a seat unit, on the one hand, and a constructional unit, on the other hand.

DETAILED DESCRIPTION

Figure 1A:
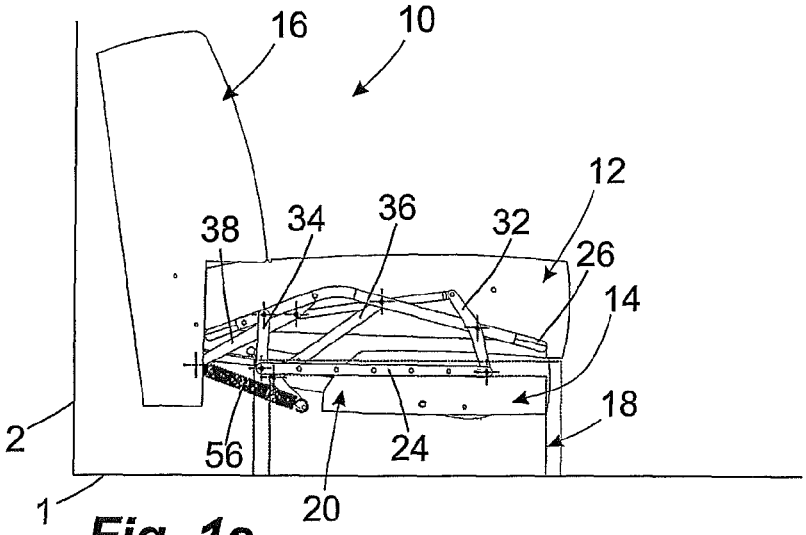
FIGS. 1*a* to 1*c* show an item of seating furniture according to the invention and the fitting thereof when the leg unit is in the storage position.

FIG. 1*a* shows an item of seating furniture 10 according to the invention, which for illustrative purposes is designed as an upholstered armchair.

The item of seating furniture 10 has three units which are moveable in relation to one another and are each upholstered, namely a seat unit 12, a leg unit 14 and a backrest unit 16.

The item of seating furniture 10 furthermore has a base framework 18 which forms the base of the item of seating furniture and is illustrated in FIG. 1*a* by means of dotted lines. The base framework 18 is arranged in a fixed position with respect to a floor 1 and a wall 2 located to the rear of the item of seating furniture 10. The item of seating furniture 10 has a movement mechanism 20 which is embodied by the furniture fitting 22 illustrated in FIG. 1*b* and which serves the purpose of ensuring the relative movement of the seat unit 12 and of the leg unit 14 from the storage position of FIG. 1*a* into the use position of FIG. 3*a*.

Figure 1B:
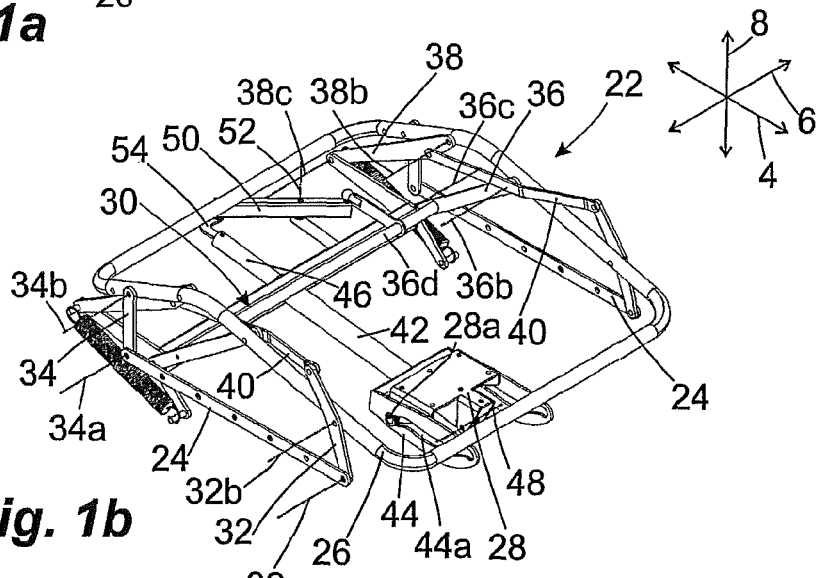

The main components of the furniture fitting 22 are explained below with reference to FIG. 1*b*. The furniture fitting 22 has two attachment strips 24 which are fixedly connected to the base framework 18. The fitting 22 furthermore has a frame 26 which, in the present case, is designed with a closed periphery and serves in a manner not illustrated specifically for the attachment of the seat unit 12 and which is therefore always moved jointly with the seat unit 12. Furthermore, for the attachment of the leg unit 14, the fitting 22 has a pivoting support 28 which always remains in a fixed position with respect to the leg unit 14.

These components are connected to one another as explained below. A number of subsequently mentioned parts of the fitting 22 are in each case provided on the left and right sides of the seat surface and designed for the corresponding movement. Only one of the components is in each case referred to here.

Two displacement levers 32, 34 are provided between the base-mounted attachment strips 24 and the seat-unit-mounted frame 26, the displacement levers each being pivotable about a base-side pivot axis 32*a*, 34*a* and each being pivotable about a frame-mounted pivot axis 32*b*, 34*b*. With this arrangement, the basic movability of the seat unit 12 in relation to the base framework 18 is provided, wherein, by means of the lever lengths which slightly differ from one another and/or the orientation of the levers in the storage position of FIG. 1*a*, a tilting movement of the seat unit 12 in relation to the base framework 18 is also forced during the course of the movement of the seat unit.

Two pivot levers 36, 38 are provided between the frame 26 and an intermediate support 30 arranged below the frame, wherein the pivot levers are pivotable about pivot axes 36*c*, 38*c* provided in a fixed position with respect to each other on the intermediate support 30 and about pivot axes 36*b*, 38*b* provided in a fixed position on the frame 26. Forced guidance is therefore also provided between the frame 26 and the intermediate support 30. The intermediate support 30 is moveable in relation to the frame 26 only along a movement path predetermined by the pivot levers 36, 38. Since the levers 36, 38 are approximately the same length, the movement takes place with only a slight tilting of the intermediate support 30 in relation to the frame 26.

The relative movement of the frame 26 in relation to the base framework 18 and the relative movement of the intermediate support 30 in relation to the frame 26 are operatively coupled to each other. For this purpose, a coupling lever 40 is provided, the coupling lever 40 being coupled pivotably at one end to an elongation of the displacement lever 32 and at the other end to the pivot lever 38. The result is that the movement of the seat unit 12 in relation to the base framework 18 also forces a movement of the intermediate support 30 in relation to the frame 26. This is also explained below.

Furthermore, an extension 42, which extends forwards from the intermediate support 30 in the direction of a furniture longitudinal axis 4 and is designed over the predominant portion of the length thereof as a hollow tube, is formed on the intermediate support 30. The end of the extension 42 is adjoined with a U-shaped end section 44, with a slotted guide track 44*a* being provided in each of the two limbs of the U-shaped end section 44, which limbs may be constructed of sheet metal. A sliding member 46 is provided within the extension 42, which member 46 is designed as a hollow tube, the sliding member being displaceable in the cavity of the hollow tube 42. At the distal end of the sliding member 46, the pivoting support 28 is coupled so as to be pivotable about a pivot axis 48. At the sides, the pivoting support 28 has guide sliders or blocks 28*a* which respectively extend into the slotted guide tracks 44*a*. A relative displacement of the sliding member 46 in relation to the hollow tube 42 causes the guide blocks 28*a* to be displaced along the slotted guide tracks 44*a* and, as a result, cause a pivoting movement of the pivoting support 28 in relation to the hollow tube 42 and the sliding member 46.

In order to be able to displace the sliding member 46 within the hollow tube 42, a control lever 50 is provided. The control lever 50 is coupled to the intermediate support 30 so as to be pivotable about a pivot axis 52. The two opposite ends of the control lever 50 are connected to a connecting rod 36*d*, which connecting rod 36*d* connects the pivot levers 36, and to the sliding member 46 via an intermediate lever 54.

The intermediate lever 54 acts here as an equalizing element and makes it possible, by the control lever 50 pivoting about the pivot axis 52, for the sliding member 46 to be pushed deeper into or to be pulled out from the extension 42, which is designed as a hollow tube.

A movement mechanism which includes a complete operative coupling between all of the components thereof is therefore provided. The arrangement of all of the other components of the furniture fitting 22 is determined by the relative position of the seat unit 12 in relation to the base framework 18, which relative position is influenced by the user.

Figure 1C:
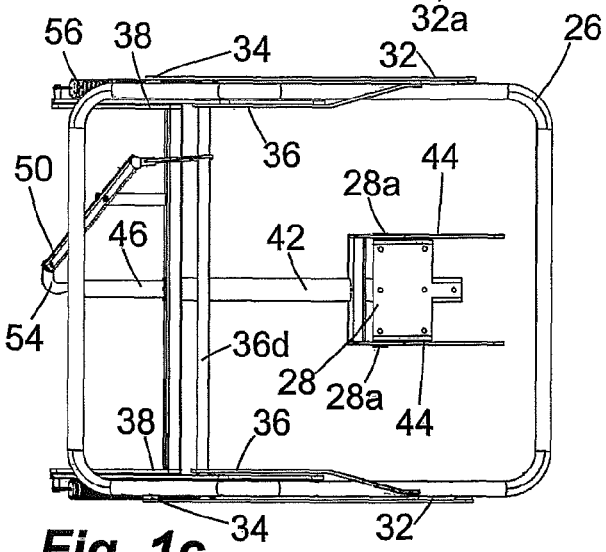
Figure 3A:
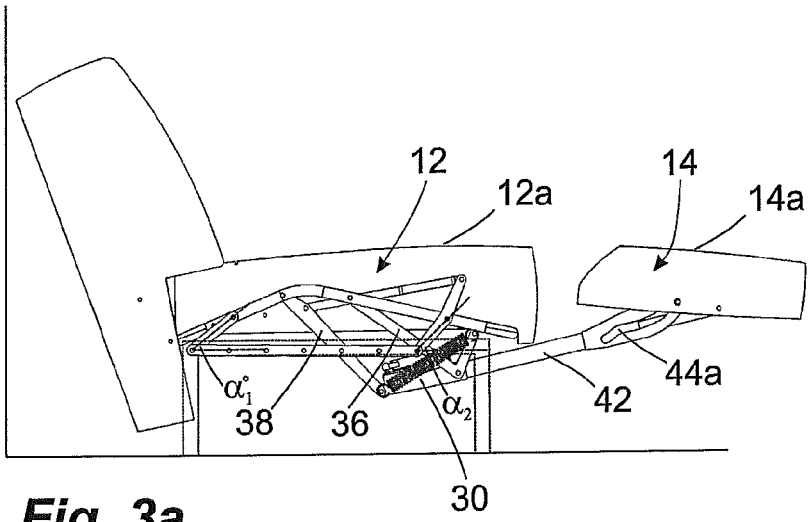
FIGS. 3*a* to 3*c* show the item of furniture and the fitting when the leg unit is in the use position.
Figure 3B:
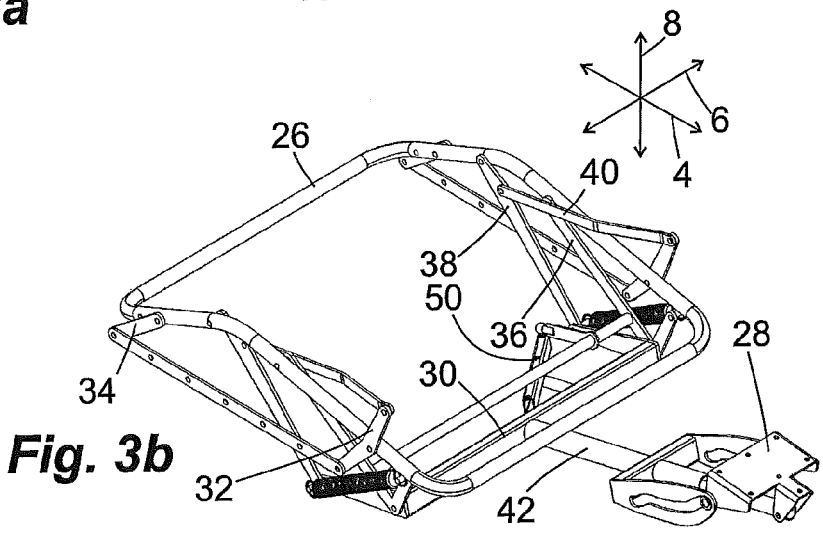
Figure 3C:
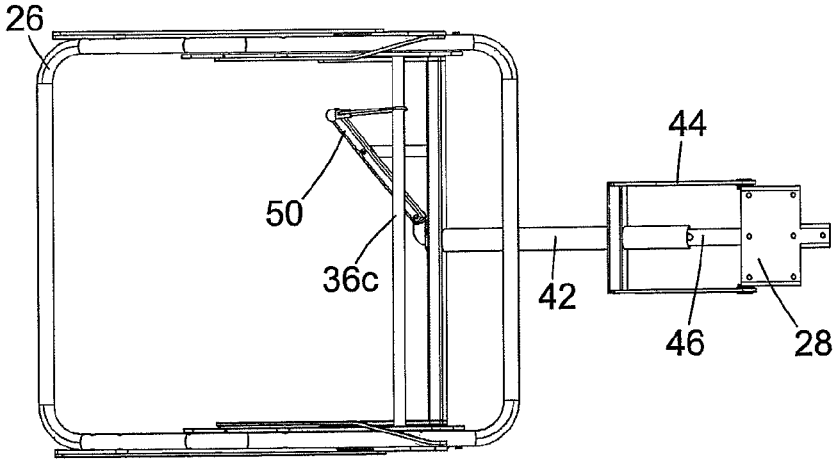

The transfer from the storage state of FIGS. 1*a* to 1*c* into a use state of FIGS. 3*a* to 3*c* is explained below according to this explanation of the individual components of the exemplary embodiment of the item of seating furniture according to the invention.

In the starting state of FIGS. 1*a* to 1*c*, in which the leg unit 14 is located below the seat unit 12, the item of furniture has the function and appearance of a simple armchair. In this state, the displacement lever 34 extends substantially vertically such that a rear end of the seat surface 12*a* takes up the highest conceivable position thereof. By contrast, in this starting position, the front displacement lever 32 is in a position beyond dead center and is angled in relation to the vertical. In order to displace the leg unit 14, starting from FIG. 1*a*, the front displacement lever 32 has to be pivoted in the clockwise direction with reference to the perspective of FIG. 1*a*. Since this is associated with a raising of a front part of the seat unit 12 on which the weight of the seated person rests, there need be no concern about an inadvertent displacement of the leg unit 14. The stability of the starting position is furthermore reinforced by a spring 56 which is coupled to the pivot levers 36, 38 and which would be extended if the seat unit 12 were displaced in relation to the base framework 18.

In order nevertheless to obtain a transfer of the item of seating furniture 10 into the state of FIG. 3*c*, the user first of all has to overcome the beyond dead center position of the displacement lever 32. The user preferably does this by being supported, for example, on the back unit 16 and displacing the seat unit 12 forwards until the displacement lever 32 is pivoted beyond the vertical. A similar action can also be obtained by an activating lever (not illustrated) which, upon actuation, permits the movement and produces an initial push for the transfer. This can also make it possible in particular to overcome the dead center position of the coupling lever 40, which position is almost provided in relation to the pivot lever 38 in the starting position.

Figure 2A:
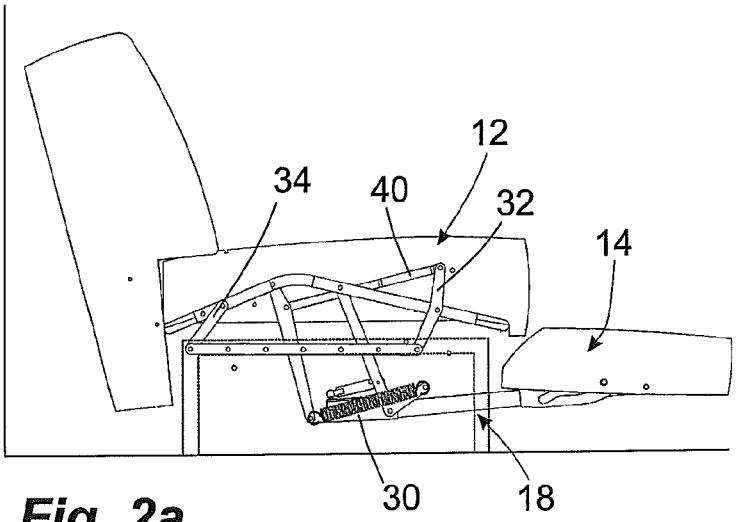
FIGS. 2*a* to 2*c* show the item of furniture and the fitting in a state when the leg unit is in an intermediate position between the storage position and a use position.

The resultant intermediate state is illustrated in FIG. 2*a*. By means of the coupling of the front displacement lever 32 to the rear pivot lever 38 via the control lever 40, displacement of the seat unit 12 leads at the same time to a displacement of the leg unit 14 in relation to the seat unit 12. The latter is shifted forwards in a manner substantially free from pivoting and guided primarily by the pivot levers 36, 38. However, the displacement is not restricted to an extent which arises by means of the pivot levers 36, 38 and by which the intermediate support 30 is displaced. Instead, owing to the operative coupling of the sliding member 46 with the intermediate support 30 and the pivot lever 36 via the control lever 50, an additional displacement of the sliding member 46 is also obtained. The sliding member 46 is pushed deeper into the hollow tube 42 forming the above-mentioned extension, wherein the sliding member 46 is moveable in a smooth-running manner in the hollow tube 42 by means of rollers provided for this purpose. At the opposite end, the pivoting support 28 to which the leg unit 14 is fastened is additionally displaced thereby in relation to the base framework 18 in the longitudinal direction 4 of the furniture. Since the sliding blocks 28*a*, which may also be designed as rollers, are thereby displaced in the slotted guide mechanisms 44*a*, a pivoting movement of the pivoting support 28 occurs at the same time.

As the movement continues, the state shown in FIGS. 3*a* to 3*c* is achieved. By means of the circular path on which the intermediate support 30 is moved, the leg unit 14 is raised in relation to the seat unit 12 towards the end of the relative movement such that, towards the end of the movement, the leg support surface 14*a* is arranged on the surface of the leg unit 14 approximately level with the seat surface 12*a*. This raising of the leg unit 14 in the final movement phase is also obtained by a slight pivoting of the extension 42 as a consequence of the configuration of the slightly differing lengths of the levers 36, 38, wherein, in order to compensate for the pivoting movement, a corresponding shaping of the slotted guide tracks 44*a* is provided such that the pivoting movement of the leg unit 14 in relation to the floor 1 in the final phase of the movement is negligibly small.

Like the starting position of FIG. 1*a*, the thus obtainable use position of the leg unit 14 illustrated in FIG. 3*a*, is very stable. Owing to the angles $\alpha 1$, $\alpha 2$ of the displacement levers 32, 34 of approximately 40° to 45° which the displacement levers take up in the state of FIG. 3*a*, a transfer of the leg unit 14 back into the state of FIG. 1*a* is first of all associated, in a first movement phase, with the seat unit 12 having to be considerably raised. Since, however, a user is sitting on the seat surface at this time, there need be no concern that the load of the user's legs is sufficient in order to inadvertently cancel the use state of FIG. 3*a*.

Furthermore, the displacement of the seat unit 12 from the starting state of FIG. 1*a* into the position of FIG. 3*a* makes it possible in the illustrated manner for the backrest unit 16 to be able to pivot into a comfort position without, in the process, entering into touching contact with the wall 2. This is obtained by the displacement of the seat unit 12.

Figure 4A:
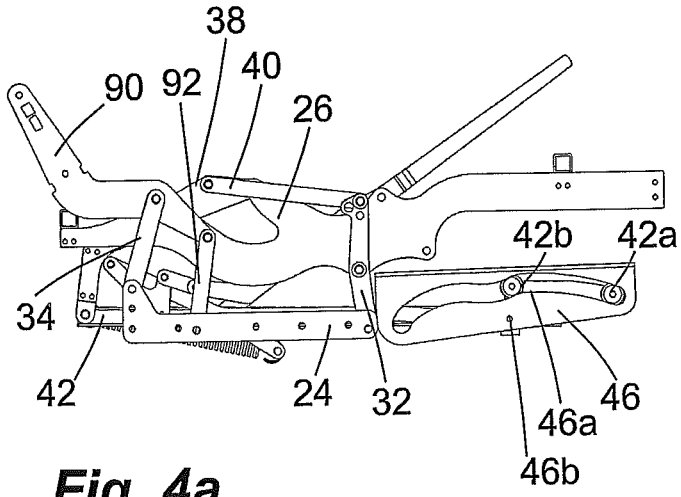
FIGS. 4*a* to 6*b* show a second embodiment of an item of seating furniture according to the invention in different use states.
Figure 5A:
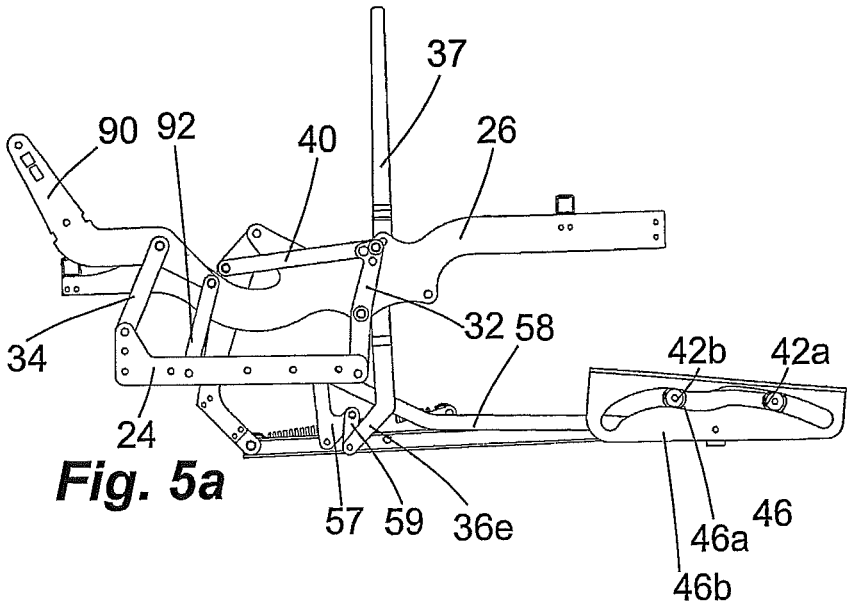
Figure 5B:
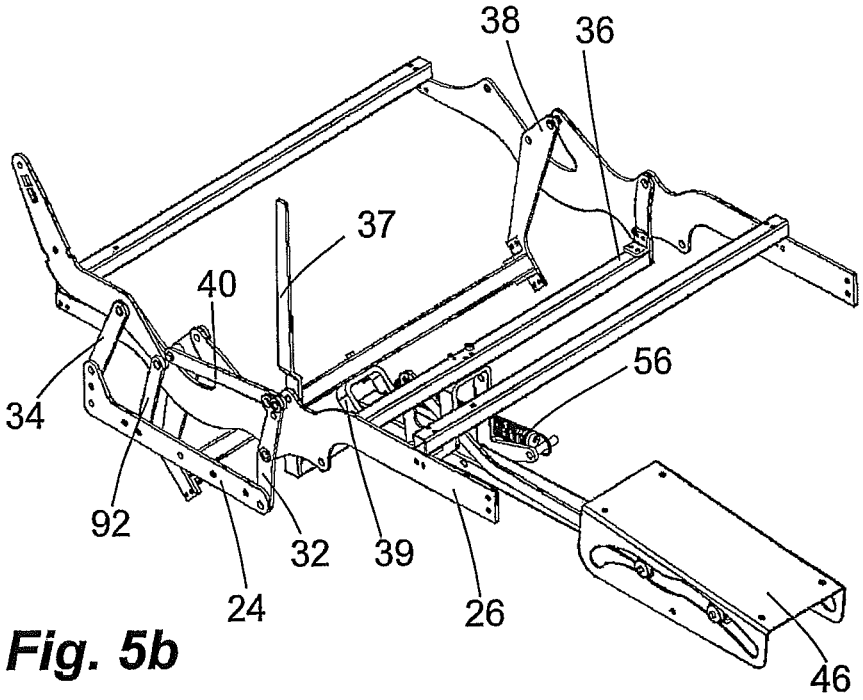
Figure 6A:
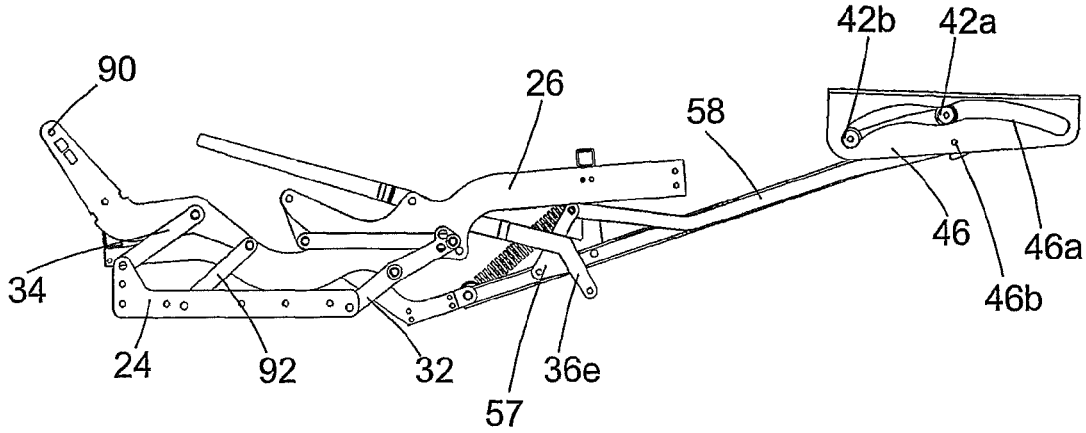
Figure 6B:
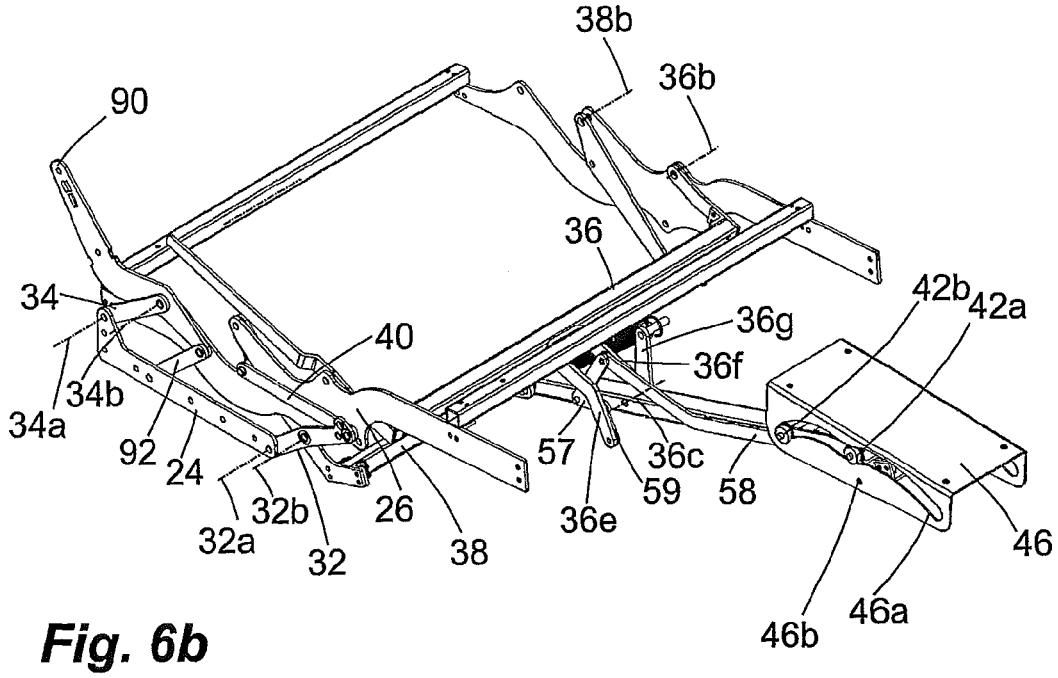

A second embodiment is shown in FIGS. 4 to 6. The second embodiment corresponds essentially to the embodiment of FIGS. 1 to 3 with regard to the functionality thereof. Essential differences are merely present in terms of the configuration of the sliding member 46 as well as in terms of the operative coupling of the sliding member 46 and the intermediate support 30 on the one hand, and in terms of the coupling of the position of the backrest with the relative position of the frame 26 of the seat unit 12 in relation to the base and the attachment strip 24 on the base side, on the other hand.

The second embodiment is illustrated in FIGS. 4-6 like the further embodiments shown in FIGS. 7 to 13 by means of the respective fitting system. Just as in the embodiment of FIGS. 1 to 3, all of these embodiments also include a seat unit 12, a leg unit 14 which can be displaced in relation thereto as well as a backrest 16. In the embodiments of FIGS. 4 to 13, these are attached fixed in position to the frame 26, fixed in position to the sliding member 46 or to the backrest supports 90.

Figure 13A:
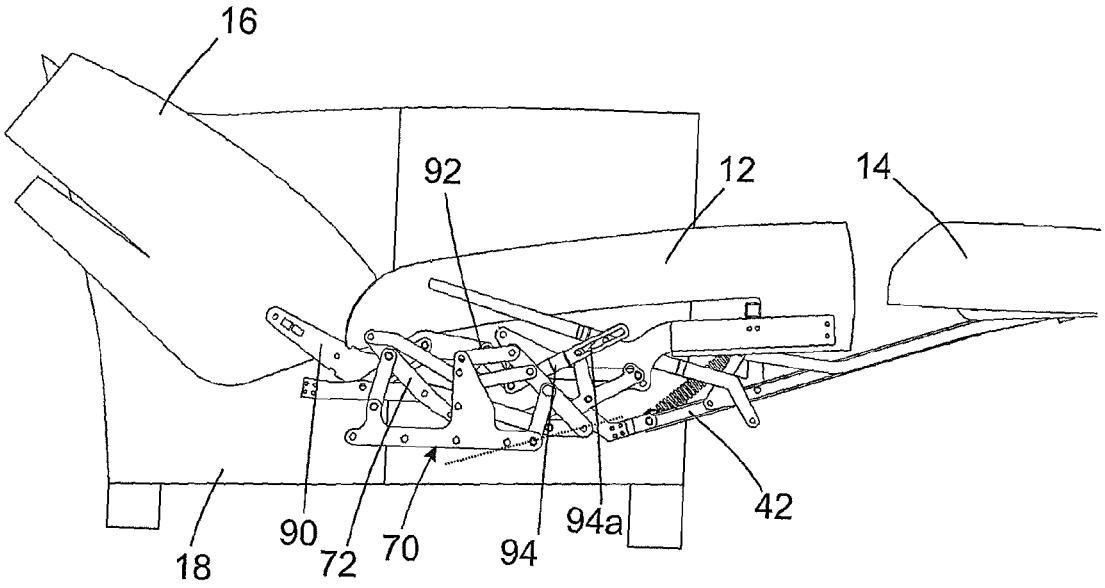
Figure 13B:
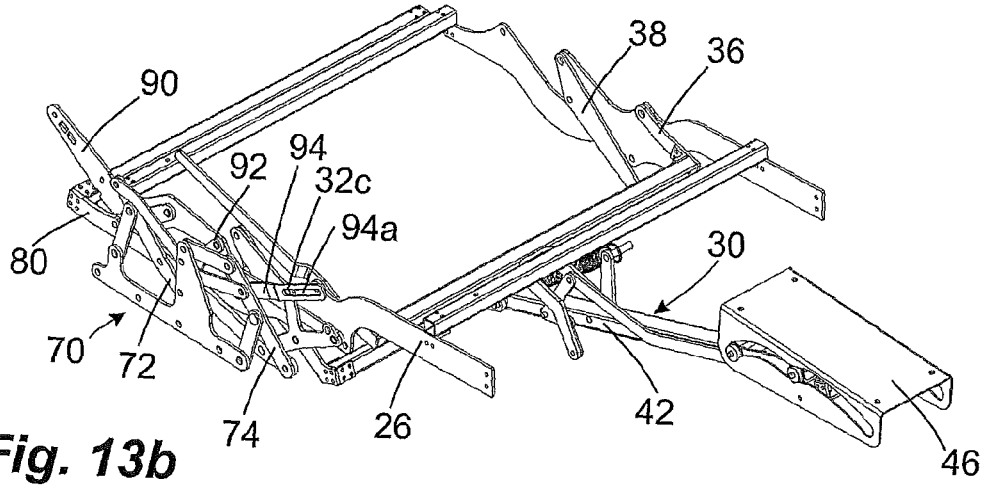

In an exemplary manner, the seat unit 12, the leg unit 14 and the backrest unit 16 of the fourth embodiment are shown in the illustration of FIG. 13*a*. In all other illustrations of the second to fourth exemplary embodiments, these units as well as the majority of the respective parts of the base are faded out for a better understanding of the operating mode.

Figure 2B:
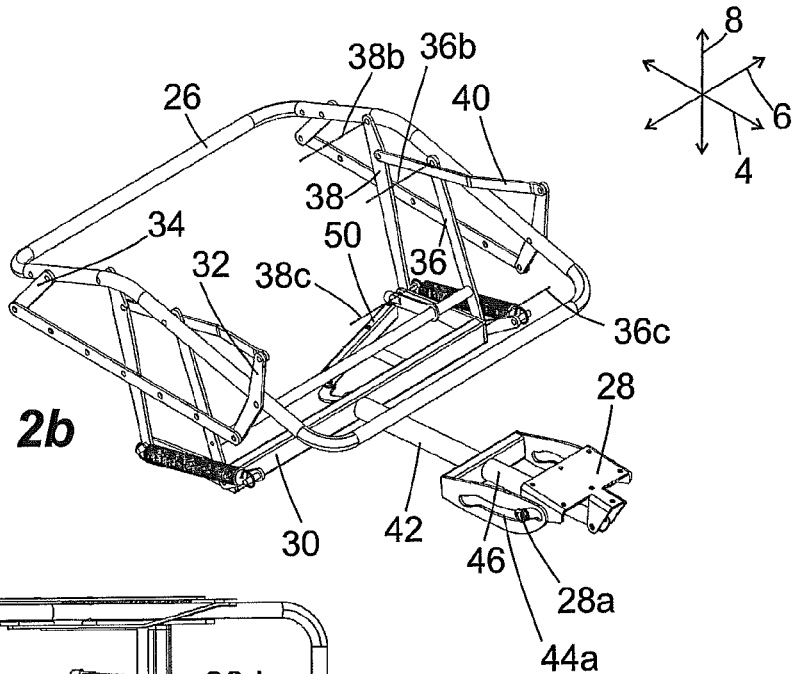
Figure 2C:
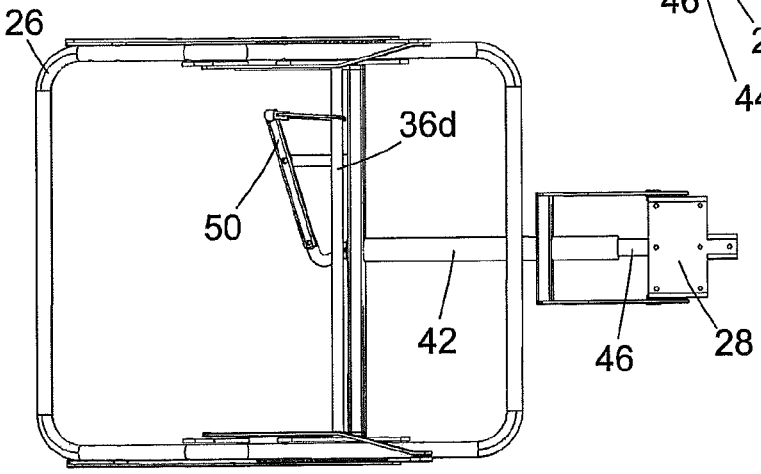

In accordance to the embodiment of FIGS. 1 to 3, the embodiment of FIGS. 4 to 6 includes a frame 26 on the seat unit side, which on the one hand can be displaced in relation to the attachment strip 24 on the base side and to which frame 26 on the other hand the intermediate support 30 and the sliding member 46 of the leg support 14 can be displaced.

The relative movability of the seat frame 26 in relation to the base and to the attachment strips 24 on the base side is made possible according to the embodiment of FIGS. 1 to 3 by means of in each case two displacement levers 32, 34 which can be pivoted around pivot axes 32*a*, 34*a* on the base side and around pivot axes 32*b*, 34*b* on the seat frame side, and by means of which not only the forward displacement of the frame 26 on the seat unit side can be achieved, but also a tilting movement of the frame 26 due to different distances of the pivot axes of both displacement levers 32, 34.

Likewise in this embodiment, the displacement of the leg unit 14 or of the sliding member 46 fixed in position relative to the leg unit 14 is achieved by means of an intermediate support 30 coupled to the frame 26 so as to be pivotable and by means of the displacement of the sliding member 46 in relation thereto.

Figure 4B:
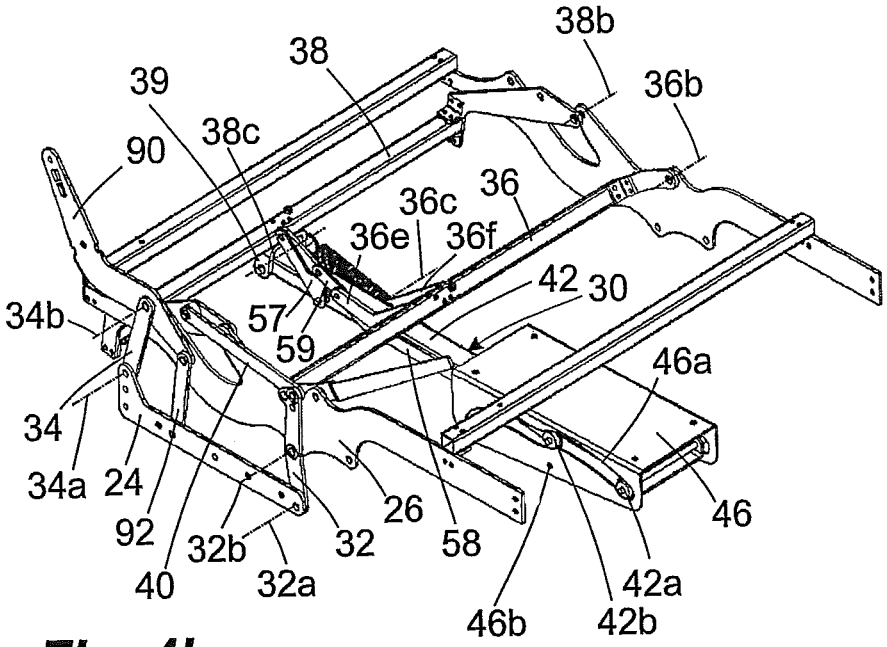

In the case of the embodiment of FIGS. 4 to 6, the intermediate support 30 is primarily formed by a tube 42 extending in the longitudinal direction of the item of furniture which can be displaced by means of a pivot guidance 36, 38. The pivot guidance 36, 38 includes two U-shaped pivot levers 36, 38. The latter can be pivoted around pivot axes 36*b*, 38*b* on the frame 26. The tube 42 is coupled pivotably to the pivot levers 36, 38 at pivot axes 36*c*, 38*c*. For this purpose, a clevis 39 is attached to the rear pivot lever 38 in a manner which can be seen from FIG. 4*b*, which clevis defines the rear pivot axis 38*c* of the tube 42. To the front pivot lever 36 is attached an asymmetric clevis of which a rear clevis arm 36*f* (based on the perspective of FIG. 4*b*) defines the front pivot axis 36*c*. Furthermore, the rear clevis arm 36*f* merges into the cantilever 36*g* fixedly attached thereto, to which a return spring 56 is attached. The function of the opposing front clevis arm 36*e* will be described subsequently.

Together, the pivot levers 36, 38 effect a forward displacement of the tube 42 wherein due to the different shapes of the pivot levers 36, 38 and the different distance between the respective pivot axes 36*b*, 36*c*, 38*b*, 38*c*, the movement of the tube 42 forwards causes a slight lifting of the front end of the tube 42 at the same time.

The sliding member 46 the leg unit 14 is configured significantly different from the configuration of member 46 of the embodiment of FIGS. 1 to 3, and is operatively coupled to the intermediate support 30 in a different manner. The sliding member 46 of the embodiment of FIGS. 4 to 6 is configured as a U-shaped profile open at the bottom and does not extend as far as under the seat unit 12 in the extended position of the leg unit 14. Instead, the member 46 does not protrude beyond the leg unit 12. The sliding member 46 includes slotted guide tracks 46*a* in its two downwardly-extending profiles. In the slotted guide tracks 46*a* in each case two guide rollers 42*a*, 42*b* are arranged which are rotatably attached to the front end of the intermediate support 30. Together, the slotted guide tracks 46*a* and the guide rollers 42*a*, 42*b* make possible a translatory displacement of the sliding member 46 in relation to the intermediate support 30. At the same time, by means of the arrangement of two guide rollers 42*a*, 42*b* which are spaced apart from one another in a fixed manner, a fixed path for the translatory displacement is defined. The slotted guide tracks 46*a* could have a linear orientation so that likewise a linear displacement of the sliding member 46 in relation to the intermediate support 30 would result. However, in the present embodiment, the guide tracks 46*a* have a form slightly deviating from linearity, so that the sliding member 46 is slightly tilted downwards on the front side in relation to the intermediate support 30 during the displacement forwards, whereby the lifting of the tube 42 of the intermediate support 30 is at least partially compensated for during the forward movement thereof.

Just as in the embodiment of FIGS. 1 to 3, there is an operative coupling between the relative position of the intermediate support 30 to the frame 26 on the seat unit side and the position of the sliding member 46 to the intermediate support 30. In a different way from the previous embodiment, the coupling is achieved by means of a lever system which is driven by the relative displacement of the front pivot lever 36 in relation to the tube 42. The lever system includes a knee lever 57 pivotably coupled to the tube 42 around a horizontal transverse axis, which lever 57 is attached to the front clevis arm 36*e* of the front pivot lever 36 by means of a first pivotable transfer lever 59. If, in the course of the pivoting of the pivot lever 36, the tube 42 is displaced forwards, the knee lever 57 is pivoted clockwise based on the perspective of FIG. 4*b*. A second transfer lever 58 is also pivotably coupled to the knee lever 57. The second transfer lever 58 extends essentially parallel to the tube 42 as far as the sliding member 46 and is pivotably coupled to member 46 in the region of a pivot axis 46*b*. Thus, by means of the lever system described, the desired operative coupling can be achieved. By means of a movement oriented forwards of the tube 42 of the intermediate support 30, the knee lever 57 is pivoted clockwise. Through this, the knee lever 57 pushes the second transfer lever 58 and along the same the sliding member 46 and the leg unit 14 attached thereto forwards.

Besides the configuration of the sliding member 46 and the operative coupling thereof with the relative position of the intermediate support 30, the second significant difference of the second embodiment is in the connection of the backrest 16. The backrest 16 is attached to the backrest support 90 in manner described above. The backrest support 90 can be pivoted in relation to the seat unit 12 and the frame 26 thereof. In this and in the following embodiments, the respective pivot axis corresponds to the pivot axis 34*b*, but could also be formed by means of a separate pivot axis spaced apart therefrom.

In order to achieve an operative coupling between the relative movement of the seat unit 12 in relation to the base, the backrest support 90 is still pivotably coupled to a control lever 92, which on the other end thereof is pivotably attached to the attachment strip 24 on the base side. Since the transfer lever 34 and the control lever 92 have an orientation deviating from one another, they cause a pivot movement of the backrest support 90 in relation to the base if the transfer lever 34 is pivoted forwards in relation to the base in the course of a transfer of the seat unit 12. With the extension of the leg support, the backrest is thus also slightly pivoted backwards.

To sum up, the embodiment of FIGS. 4 to 6 thus includes the following, operatively-coupled partial components. In relation to the seat unit 12 and the frame 26 thereof, starting from the first use position of FIG. 4*a*, the intermediate support 30 can be pivoted forwards, wherein by means of the lever system including the levers 59, 57, 58, at the same time a displacement forwards of the sliding member 46 in relation to the intermediate support 30 is caused. The displacement forwards of the intermediate support 30 and of the sliding member 46 is effected by means of a force application to the seat unit 12 by means of the person sitting thereon and/or by means of a simultaneous operation of the operation lever 37. Thereby, the seat unit 12 together with the frame 26 can be displaced forwards in relation to the base. The movement is coupled to the pivot movement of the intermediate support 30 in a compelled manner via the coupling lever 40. The movement forwards of the seat unit 12 and of the frame 26 furthermore also causes a pivoting of the backrest 16 into a slightly more flat and comfortable position.

In the case of the third embodiment FIGS. 7 to 9, the seat unit 12 together with the frame 26 on the seat unit side as well as together with all mechanical components of the intermediate support 30, the sliding member 46 and of the leg unit 14 are identically configured with respect to the embodiment of FIGS. 4 to 6, so that reference is made to the description given there.

The particular feature of the embodiment of FIGS. 7 to 9 as well as of the embodiment of FIGS. 10 to 13 subsequently described is that the respective item of furniture cannot only be used in the manner already described between a first use position with the leg unit 14 under the seat unit 12 and a second use position with the leg unit 14 in front of the seat unit 12, but that it also includes a third use position in which, with the leg unit 14 extended, the backrest 16 is significantly lowered so that comfortable resting on the item of furniture is made possible.

In this case, it is desired that the backrest 16 is not further displaced backwards or is only slightly further displaced backwards in the third use position in relation to the first use position, so that the item of furniture in the first use position can be arranged flush with a wall and nevertheless allows the transfer into the third use position and the resting accommodation offered thereby without the movement of the backrest 16 being encumbered by the wall.

For this purpose, in the present third as well as in the subsequent fourth embodiment, provision is made such that the displacement of the seat unit is not limited to the dimension offered by means of the displacement levers 32, 34. In addition, a displacement unit 80 is provided, which functionally is arranged between the base 18 and the seat unit 12 together with the frame 26 and which on its part can also be displaced forwards.

Figure 7A:
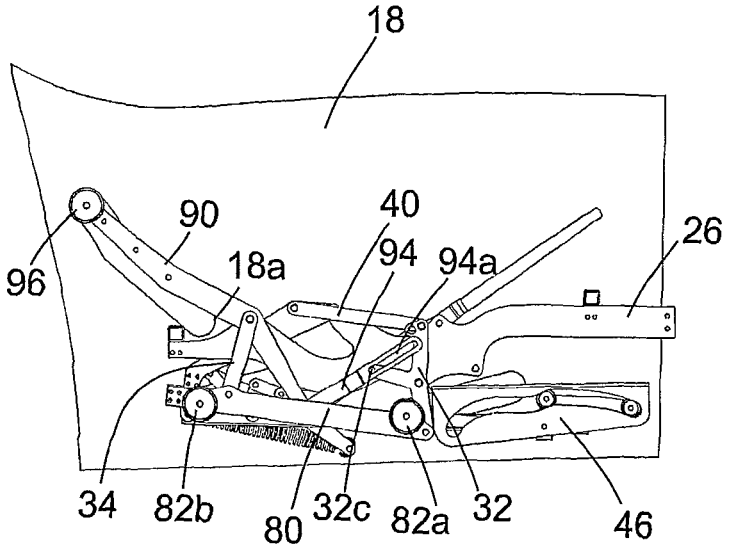
FIGS. 7*a* to 9*b* show a third embodiment of a item of seating furniture according to the invention in different use states.
Figure 7B:
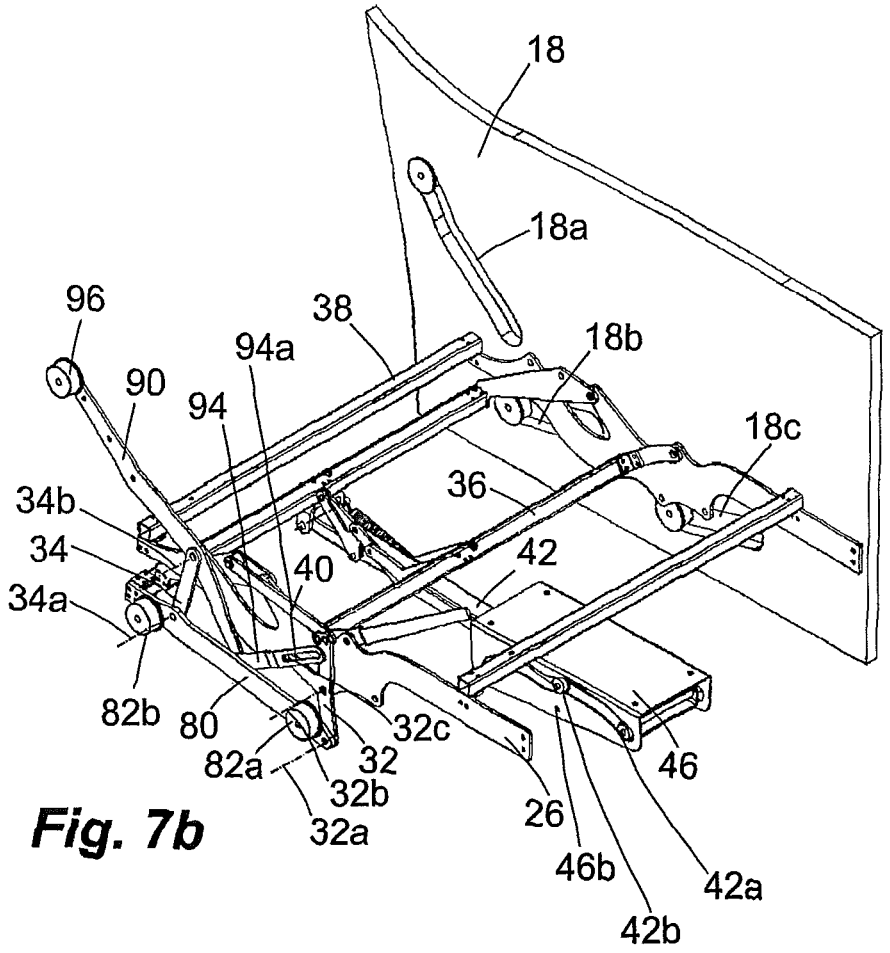

It can be seen from FIG. 7*b* that the displacement unit 80 replaces the attachment strip 24 on the base side of the first two embodiments with regard to the attachment of the displacement levers 32, 34. The seat unit 12 together with the frame 26 and indirectly the intermediate support 30 as well as the sliding member 46 can be moved in relation to the displacement unit 80 in the same way as they can be moved in the embodiment of FIGS. 4 to 6 in relation to the base 18 and the attachment strip 24 thereof.

However, the displacement unit 80 itself can additionally be moved in relation to the base 18 in the case of the embodiment of FIGS. 7 to 9. As a result, a further increased movability of the seat unit 12 in relation to the base is achieved. The relative movability of the displacement unit 80 in relation to the base 18 is achieved by means of two slotted guide tracks 18*b*, 18*c* provided in side surfaces of the base 18, and where in each case one guide roller 82*a*, 82*b* is inserted, which guide rollers 82*a*, 82*b* are rotatably supported on the displacement unit 80. The slotted guide tracks 18*b*, 18*c* are slightly inclined with a forward rising slope.

Since in the embodiment of FIGS. 7 to 9 the resting accommodation is considered to be provided as a third use state of the item of seating furniture, the coupling of the backrest support 90 to the other components of the item of seating furniture is realized in a way different from the configuration of the embodiment of FIGS. 4 to 6.

There are further slotted guide tracks 18*a* on both sides for the backrest support 90 which are also provided in side surfaces of the base 18. The technical purpose of this configuration will subsequently be explained.

Figure 8A:
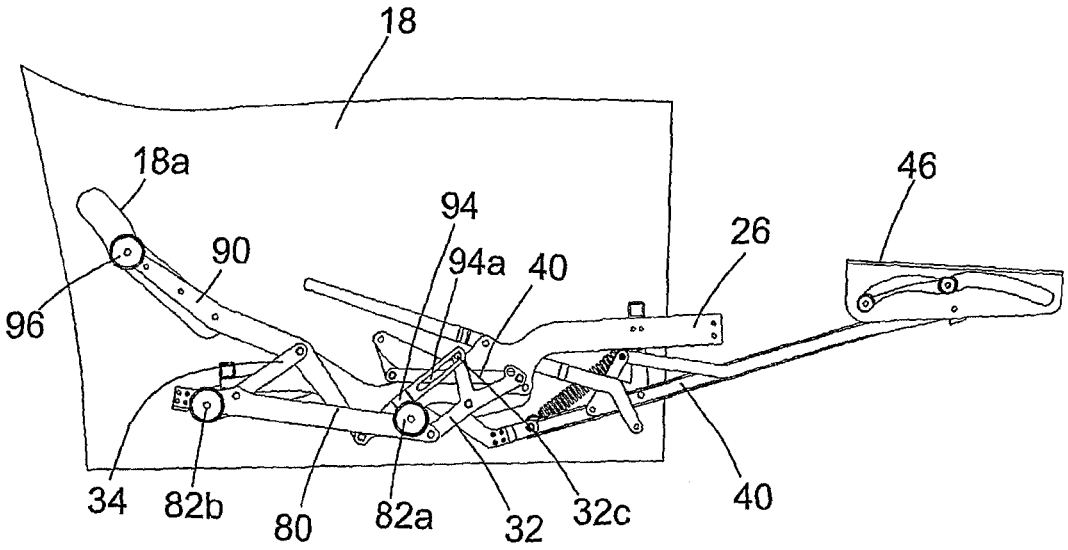
Figure 8B:
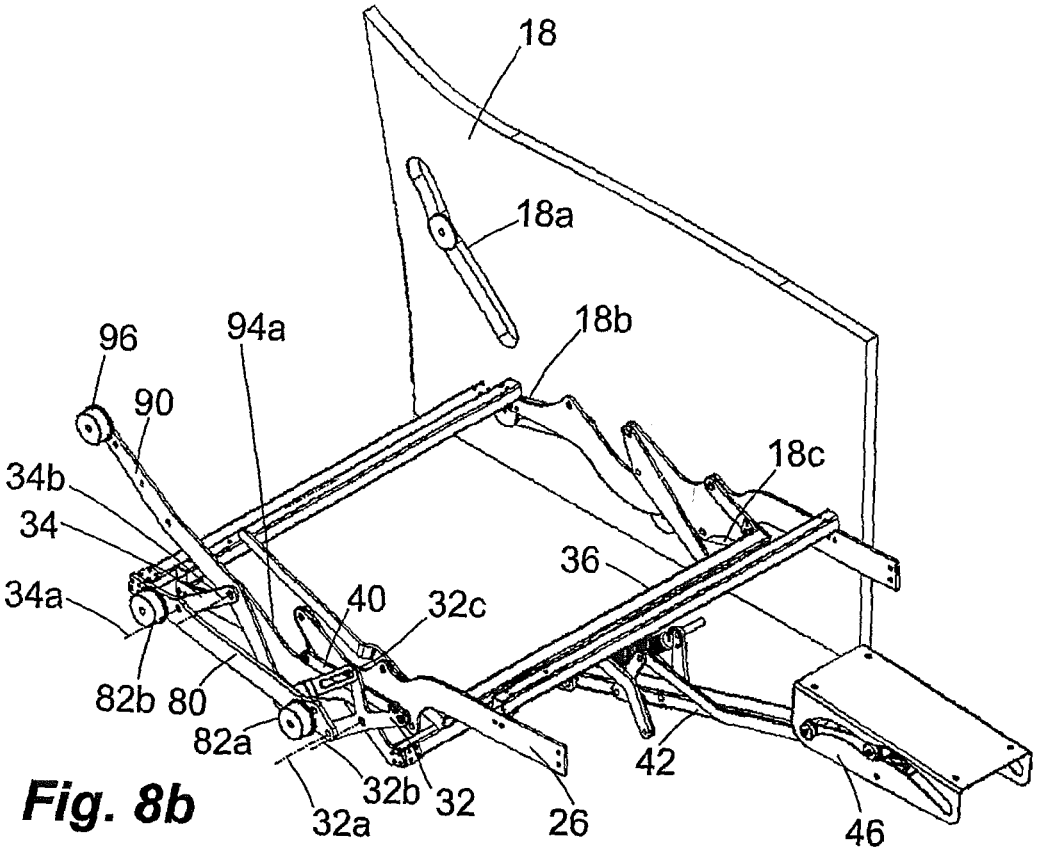

As can be seen from the transfer from the first use state of FIGS. 7*a* and 7*b* into the second use state of FIGS. 8*a* and 8*b*, the position of the guide rollers 82*a*, 82*b* in the slotted guide tracks 18*b*, 18*c* initially remains unchanged during the transfer. The movement of the leg unit and of the respective sliding member 46 as well as of the intermediate support 30 during the transfer is effected in the same way as in the case of the embodiment of FIGS. 4 to 6.

The unchanged position of the guide rollers 82*a*, 82*b* during the transfer from the initial position into the second use state of FIGS. 8*a*, 8*b* on the one hand is subject to the inclined orientation of the slotted guide tracks 18*b*, 18*c*. However, an intentional or unintentional displacement of the displacement unit 80 during the first transfer phase into the second use state is also prevented by pivotably attaching a bracket 94 to the backrest support 90, in which a slot hole 94*a* is provided. A bolt 32*c* extends into the slot hole 94*a*, which bolt 32*c* is provided at the front displacement lever 32 and which bears against a stop region limiting the slot hole 94*a* on the end side thereof in the first use state of embodiment of FIGS. 7*a* and 7*b*. The bolt 32*c* and the slot hole 94*a* thereby prevent an immediate lowering of the backrest in the first use state of FIGS. 7*a* and 7*b*.

Thus, the backrest is lowered only to a minor extent during the transfer from the first use state of FIGS. 7*a* and 7*b* into the second use state of FIGS. 8*a* and 8*b*. The minor extent is predefined by means of the shape of an upper section of the slotted guide track 18*a*. When the seat unit 12 together with the frame 26 is displaced forwards during the transfer into the second use state, likewise the pivot axis 34*b* of the backrest 16 is displaced forwards and the backrest 16 guided by the rollers 96 in the slotted guide tracks 18*a* is slightly pivoted. In principle, by means of another shape of the slotted guide tracks 18*a* in the upper partial section thereof, a configuration would be possible where the transfer from the first into the second use state does not yet cause any pivoting movement of the backrest 16.

As soon as the second use state of FIGS. 8*a* and 8*b* is reached, the displacement levers 32, 34 are pivoted forwards according to the second use state of FIGS. 5*a* and 5*b* of the preceding embodiment. Hereby, also the bolt 32*c* on the front displacement lever 32 in the slot hole 94*a* of the corresponding bracket 94 is now arranged on the opposite end of the hole 94*a*.

Figure 9A:
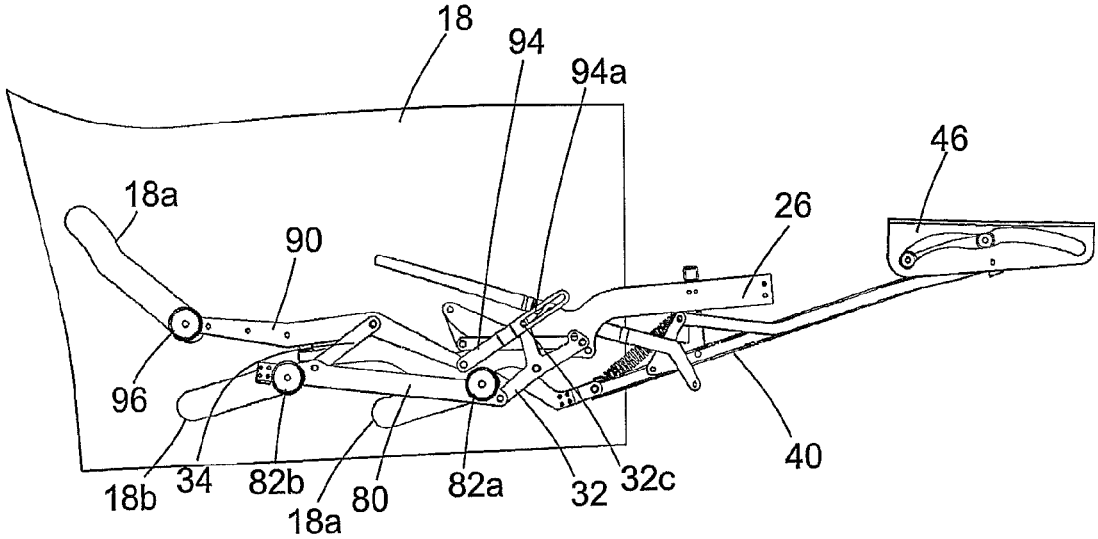
Figure 9B:
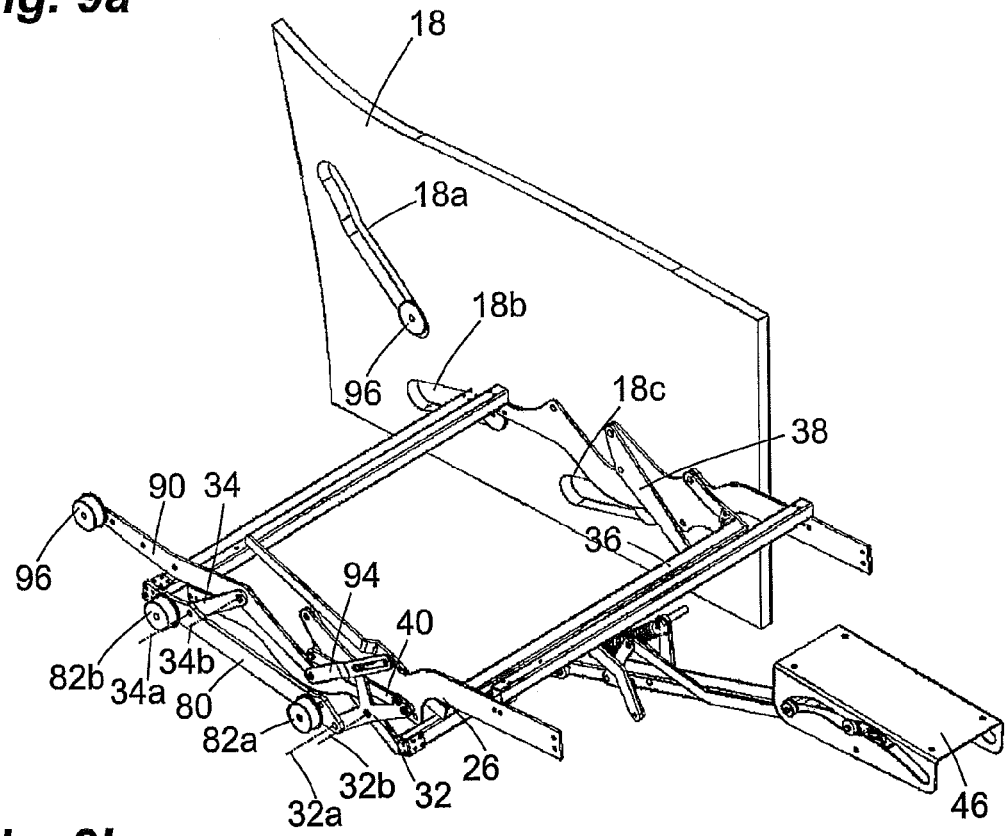

Thus, starting from the second use state, the item of furniture can then be transferred into the third use state of FIGS. 9*a* and 9*b*, where the backrest 16 is pivoted downwards significantly further. The transfer into the third use state is initiated by the sitting person pressing his or her back against the backrest 16 and/or pressing the seat unit 12 forwards.

Thereby, the backrest rollers 96 in the slotted guide tracks 18*a* are pressed downwards beyond the position of FIGS. 8*a* and 8*b*. The effect thereof is an independent forced displacement forwards of the displacement unit 80 together with the seat unit 12 and the extended leg unit 14 in relation to the base, wherein this is effected by a forward rolling of the slotted guide rollers 82*a*, 82*b* in the slotted guide tracks 18*b*, 18*c*. Besides the forward displacement, this also leads to a slight upward displacement of the displacement unit 80 and of the seat unit 12 due to the orientation of the slotted guide tracks 18*b*, 18*c*.

As can be seen from comparing FIGS. 8*a* and 8*b* on the one side and FIGS. 9*a* and 9*b* on the other side, all mechanical components influencing the relative movement of the seat unit 12 in relation to the displacement unit 80 and the relative movement of the intermediate support 30 as well as the sliding member 46 in relation to the seat unit 12 remain in an unchanged position in relation to one another in the third use state of FIGS. 9*a* and 9*b*. All of the components are displaced merely in the entirety thereof forwards or slightly upwards. During the transfer into the third use state, only the backrest support 90 and the brackets 94 pivotably coupled thereto with the slot holes 94*a* are moved in relation to the components.

In the third use state of FIGS. 9*a* and 9*b*, comfortable resting is possible on the item of furniture with a far-pivoted backrest 16 and extended leg unit 14.

During the re-transfer, it is desired that initially only the backrest 16 is returned into a closer to vertical position again without displacement of the leg unit 14 in the direction of its storage position in relation to the seat unit 12 at this early stage. The stop region or end of the slot hole 94*a* serves this purpose as well. As can be seen from FIGS. 9*a* and 9*b*, also in the third use state the bolt 32*c* is again arranged at the end limit of the slot hole 94*a*. A direct pivoting of the leg unit 14 which would indirectly also involve pivoting of the pivot lever 32, is therefore initially impossible. Not until the backrest support 90 is pivoted back in the direction of its upright position will the slot hole 94*a* be displaced and then allow a movement of the leg unit 14. The retransfer from the third use state into the second use state is facilitated by the weight of the sitting person which presses the slotted guide rollers 82*a*, 82*b* in the slotted guide tracks 18*b*, 18*c* in the direction of the initial position thereof.

The embodiment of FIGS. 10 to 13 is functionally very similar to the embodiment of FIGS. 7 to 9. The item of seating furniture with the fitting thereof shown in FIGS. 10 to 13 is also provided for use in a first, second and third use state, wherein again in the first use state the backrest 16 is upright and the leg unit 14 is retracted, in the second use state the leg unit 14 is extended, and in the third use state with extended leg unit 14, the backrest 16 is significantly pivoted in order to achieve a reclined position.

Unlike the configuration of FIGS. 7 to 9, however, slotted guide tracks 18*a*, 18*b*, 18*c* are dispensed with. Instead, an additional lever system 70 is provided which replaces the function of the slotted guide tracks of the preceding embodiment.

Figure 10:
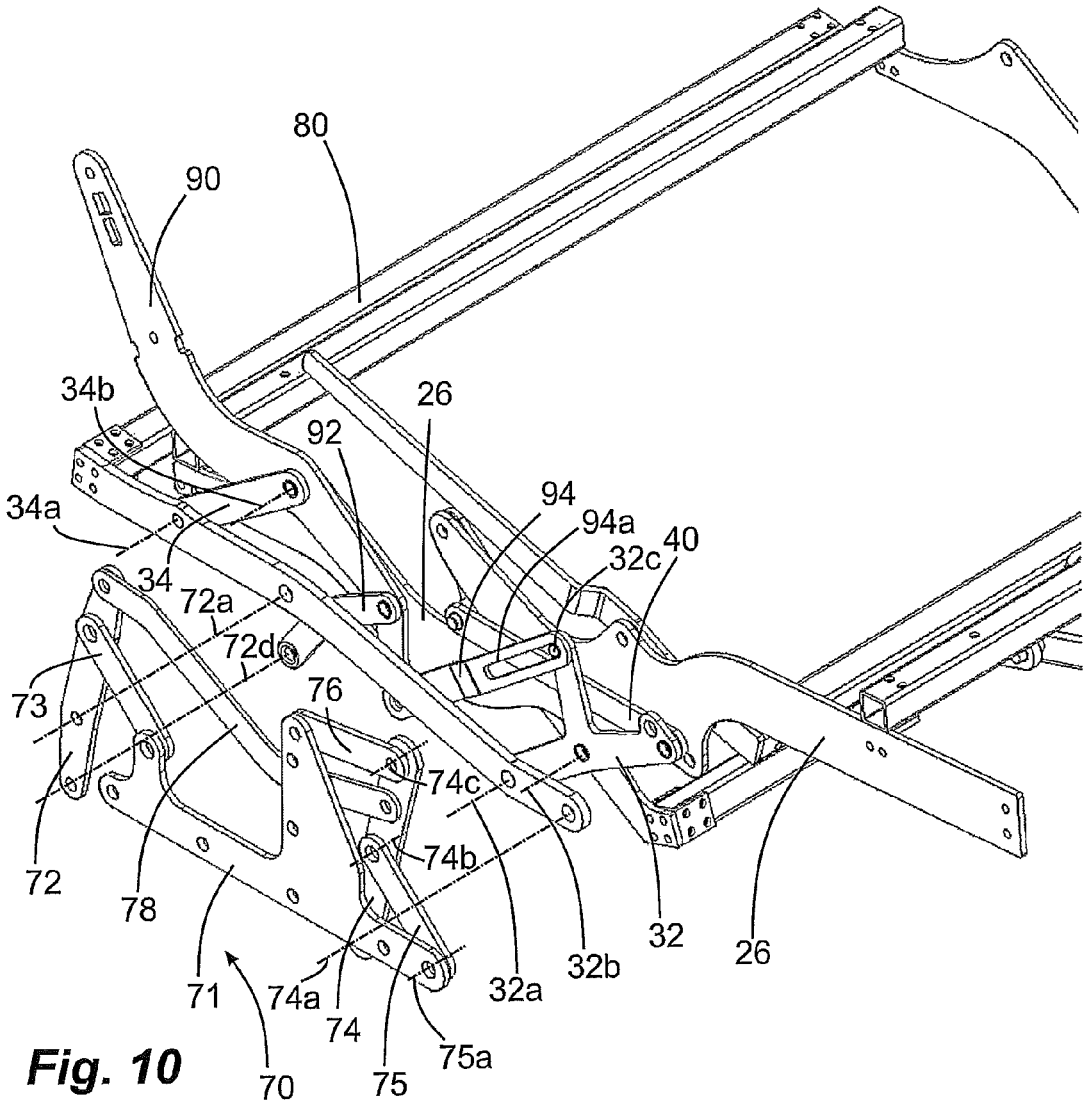
FIGS. 10 to 13*b* show a third embodiment of an item of a seating furniture according to the invention in different use states.

FIG. 10 shows an exploded view in which the lever system 70 has been removed from the displacement unit 80 for explanatory purposes. To begin with, this illustration reveals that the entire assembly group including the displacement unit 80, the seat unit 12 together with the frame 26 pivotably supported relative to unit 80 by means of the displacement levers 32, 34, and the intermediate support 30 again pivotably supported relative to frame 26 with the sliding member 46 being displaceable in a translatory manner in relation to intermediate support 30, is functionally almost identical to the configuration of FIGS. 7 to 9. The only functionally important differences are the omission of the guide rollers 82*a*, 82*b* as well as the presence of an additional control lever 92 for connection of the backrest support 92, which function will subsequently be explained.

The additional lever system 70 includes an attachment strip 71 fixedly attached to the base, in relation to which two movement levers 72, 74 can be displaced. The movement levers 72, 74 are in each case not directly pivotably attached to the attachment strip 71 but by means of further intermediate levers which will subsequently be explained. In turn, the two movement levers 72, 74 include holes defining pivot axes 72*a*, 74*a*, in the region of which the displacement unit 80 is pivotably attached to the movement levers 72, 74.

The intermediate levers by means of which the movement levers 72, 74 are moveable in relation to the attachment strip 71 in a defined manner serve the purpose of ensuring a movability of the displacement unit 80 in relation to the attachment strips approximately corresponding to the movability provided by the slotted guide tracks 18*b*, 18*c* in the exemplary embodiment of FIGS. 7 to 9. In this case, the intermediate levers ensure an approximately linear movability.

This is explained using the example of the front movement lever 74. The movement lever 74 is attached to the attachment strip 71 by means of two pivotable intermediate levers 75, 76. In this case, the lower intermediate lever 75 is of particular importance. The lever 75 is adjusted to the movement lever 74 in such a way that the distance between the pivot axis 74*a*, in the region of which the displacement unit 80 is attached to the movement lever 74, and the pivot axis 74*b*, around which the intermediate lever 75 is pivotably attached to the movement lever 74, essentially corresponds to the distance between the pivot axis 74*b* and the pivot axis 75*a* around which the intermediate lever 75 is pivotably coupled to the attachment strip 71. At the same time, the distance between the pivot axis 74*b* and the coupling axis 74*c* around which the intermediate lever 76 is coupled to the movement lever 74 also corresponds approximately to this distance.

Figure 12A:
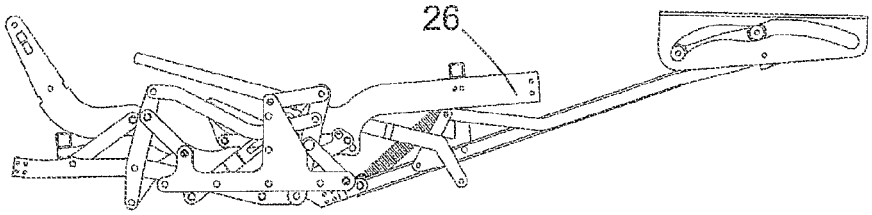
Figure 12B:
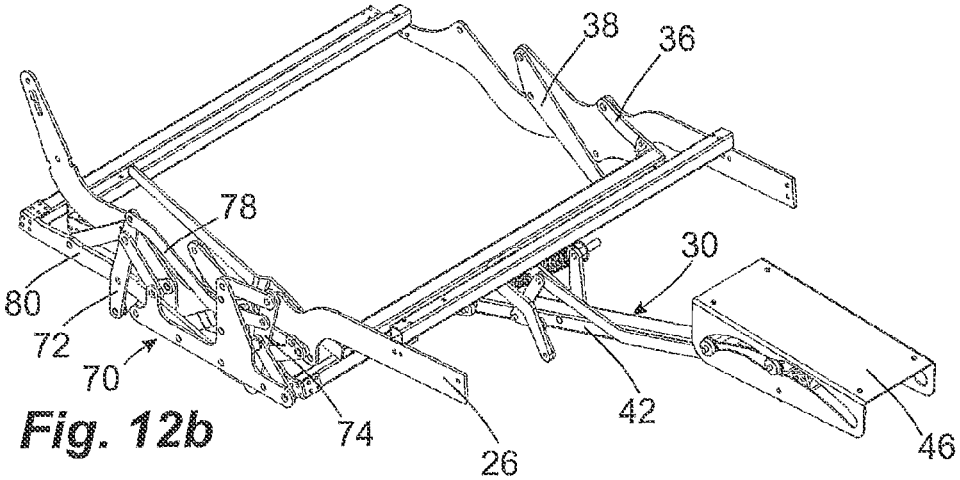

The desired almost linear movability of the pivot axis 74*a* in relation to the attachment strip 71 is achieved in that the distances between the pivot axes 74*a* and 74*b*, between the pivot axes 74*b* and 75*a*, and between the pivot axes 74*b* and 74*c* are correspondent to one another or almost correspondent. In FIGS. 12*a* and 13*a*, this is illustrated by a dotted line. Just as do the slotted guide tracks 18*b*, 18*c* of the previous embodiment, the dotted line has an inclination of approximately 15° with a forward rising slope.

With regard to the rear movement lever 72, a construction almost identical to front movement lever 74 with its intermediate levers 75, 76 would also be possible. In order to save space, however, in this case a somewhat different configuration has been selected which uses the already defined movability of the front movement lever 74 by means of a coupling lever 78. Indeed, with the intermediate lever 73 an intermediate lever having the same effect as the intermediate lever 75 is provided at the rear movement lever 72. However, a lever corresponding to the intermediate lever 76 was dispensed with. Instead, it is achieved by means of the mentioned coupling lever 78 that the movement path of the pivot axis 72*a* is approximately oriented parallel to the movement path of the pivot axis 74*a*.

The outcome is thus that the lever system 70 is capable of replacing the slotted guide tracks 18*b*, 18*c* of the previous exemplary embodiment. The lever system 70 ensures an almost identical relative movability of the displacement unit 80 in relation to the base 18.

Unlike the configuration of FIGS. 7 to 9, the attachment of the backrest support 90 is also effected. For this purpose, the aforementioned control lever 92 is provided in a manner similar to the embodiment of FIGS. 4 to 6. However, the lever cannot be pivotably coupled to the displacement unit 80 in a manner corresponding to FIGS. 4 to 6, since this would counteract an additional pivotability during the transition from the second use state to the third use state because during the transition, there is no relative displacement of the backrest pivot axis 34*a* in relation to the displacement unit 80.

Therefore, in a manner that can be seen from FIG. 10, the control lever 92 is instead pivotably attached around the pivot axis 72*d* to the rear movement lever 72.

The transferability of the item of seating furniture from the first use state into the second use state and further into the third use state resulting from the structure described, essentially corresponds to the transferability in the preceding exemplary embodiment.

Figure 11A:
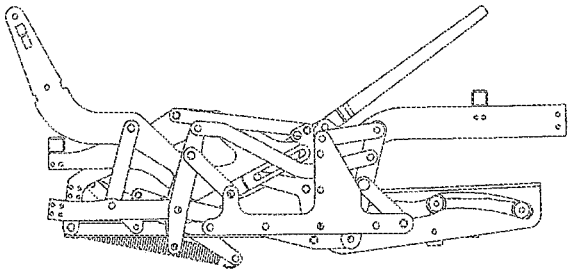
Figure 11B:
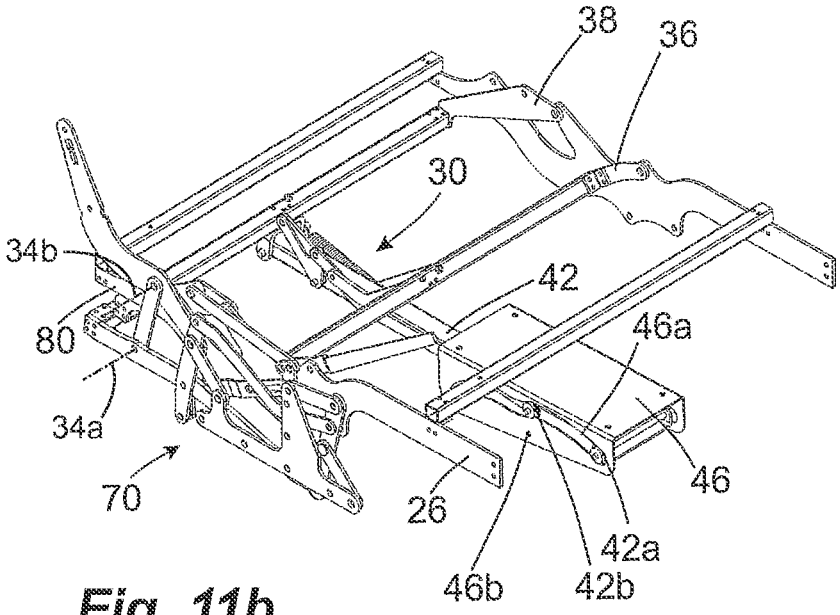

Starting from the first use state of FIGS. 11*a* and 11*b*, a forward displacement of the seat unit 12 together with its frame 26 in relation to the elements of the displacement unit 80 which initially remain fixed in position relative to one another and the lever system 70 fixedly attached to the base leads to the extension of the leg unit in the same manner as in the preceding exemplary embodiments. Upon reaching the second use state of FIGS. 12*a* and 12*b*, a further forward displacement of the seat unit and a force application to the backrest and thus to the backrest support 90 results and, due to the operative coupling of the control lever 92 to the lever 72, the pivot axes 74*a*, 72*a* are displaced forwards in an approximately linear manner and in a slightly rising manner (as indicated by the dotted line) in relation to the attachment strip 71 fixed to the base wherein at the same time, there is achieved a pivoting of the backrest 16. In the final state of FIGS. 13*a* and 13*b*, which is the third use state, the item of seating furniture allows a comfortable reclined position.

The embodiments are to be understood as exemplary and merely serve to illustrate the invention and partial aspects thereof. It is obvious to the person skilled in the art that variations of the embodiments are possible without leaving the scope of the invention.

In that context, different embodiments are conceivable and are within the scope of the invention in which parts of the fitting can be provided merely on one side of the seat surface or on both sides of the seat surface. The components ensuring the relative movabilities are preferably, but not in a mandatory way, provided on both sides. This applies in particular to the connections of the pivot levers 36, 38 to the frame 26 of the seat unit, for connecting the frame 26 to the attachment strips 24 or to the displacement units 80 by means of the displacement levers 32, 34 and it applies to the slotted guide systems 18*a*, 18*b*, 18*c*, 82*a*, 82*b*, 96 or the corresponding lever system 70, respectively. Other components leading to the coupling of the relative movabilities are preferably present on one side, but could also be provided symmetrically on both sides. This applies, for example, to the levers 57, 58, 59 assigned to the sliding member 46, in particular to the lever 58, to the coupling lever 40 for operative coupling of the movement of the intermediate support 30 with the seat frame 26 and to the control lever 92 for operative coupling of the movement of the seat frame 26 or of the displacement unit 80 with the movement of the backrest unit 16.

Furthermore, it is obvious to the person skilled in the art that the techniques described in this case are illustrated only exemplary by means of a single chair, but can also be used one time or several times with sofas.

It is also obvious to the person skilled in the art that an item of furniture according to the invention can include further partial units which can be fixed in position to the described partial units or which can be separately moveable in relation to these parts. Included therein are in particular arm rests which can be provided fixed in position to the seat unit.

Furthermore, the person skilled in the art can conceive that the specifically named components which are provided fixed in position to the different units, to the base, the seat unit, the leg unit and the backrest unit, are to be understood as exemplary. Thus, for example the attachment strips 24, 71 and the side parts of the base, the seat frame 26, the U-shaped sliding member 46 and the backrest support 90 can be replaced by other components which are suitable for attaching the respective functional elements, such as in particular levers and slotted guide tracks, without departing from the scope of the invention.

I claim:

1. An item of seating furniture comprising:

a base fixed in position during use of the item of seating furniture;

a seat unit with a seat surface;

a leg unit moveable in relation to the seat unit and having a leg support surface; and a backrest unit operationally coupled to movement of the seat unit in relation to the base;

wherein the leg unit is displaceable by a movement mechanism between a storage position, in which the leg support surface is arranged under the seat unit, and a use position, in which the leg support surface is arranged in front of the seat unit, wherein:

the movement mechanism is designed for transferring the leg unit from the storage position, in which the leg support surface is oriented substantially horizontally, into the use position, in which the leg support surface is likewise oriented substantially horizontally, the movement mechanism has an intermediate support which is displaceable in relation to the seat unit or the base by a pivoting guide, wherein the pivoting guide has at least one first pivot lever between the intermediate support and the seat unit or the base, the movement mechanism has a sliding guide with a sliding member, wherein the sliding member is guided in a translatory manner on the intermediate support, and wherein the leg unit is attached to the sliding member, and the first pivot lever has a first pivot axis positionally fixed relative to the intermediate support and a second pivot axis positionally fixed relative to the seat unit or the base.

2. The item of seating furniture according to claim 1, wherein a forced guide is provided by which each pivoting position of the first pivot lever in relation to the seat unit or in relation to the base is associated with a resultant pivoting position of the intermediate support in relation to the first pivot lever.

3. The item of seating furniture according to claim 1, wherein the pivoting guide has a second pivot lever which is coupled to the seat unit or to the base so as to be pivotable about a third pivot axis spaced apart from the first pivot axis, and also is coupled to the intermediate support so as to be pivotable about a fourth pivot axis spaced apart from the second pivot axis.

4. The item of seating furniture according to claim 3, wherein the first pivot lever is arranged in such a manner that the first pivot lever remains completely to a rear of a front edge of the seat surface irrespective of a position of the intermediate support.

5. The item of seating furniture according to claim 1, wherein the pivoting guide and the sliding guide are operatively coupled to each other such that, depending on a relative position of the intermediate support in relation to the seat unit or the base, a relative position, which is dependent thereon, of the sliding member with respect to the intermediate support is set.

6. The item of seating furniture according to claim 1, wherein an extension which extends as far as the leg support surface is provided on the intermediate support, and a pivoting mechanism is provided on the leg unit, wherein the pivoting mechanism is designed for bringing about pivoting of the leg unit in relation to the sliding member depending on the relative position of the sliding member with respect to the extension.

7. The item of seating furniture according to claim 6, wherein the extension or the sliding member are arranged, with respect to a transverse direction of the item of furniture, in a central region which, at maximum, takes up one third of a width of the seat surface.

8. The item of seating furniture according to claim 6, wherein the pivoting mechanism has a pivoting support which is pivotable about a fifth pivot axis, which is arranged in a fixed position with respect to the sliding member, and is connected immovably to the leg unit.

9. The item of seating furniture according to claim 6, wherein the pivoting mechanism has a slotted guide mechanism with a slotted guide track and a slotted guide slider, via which the pivoting support is operatively coupled to the extension.

10. The item of seating furniture according to claim 1, wherein the seat unit is designed to be displaceable in relation to the base of the item of seating furniture, wherein relative movement of the seat unit in relation to the base is operatively coupled to relative movement of the intermediate support in relation to the seat unit.

11. The item of seating furniture according to claim 10, wherein movability of the seat unit in relation to the base is provided by two displacement levers which are each coupled pivotably to the base and to the seat unit.

12. The item of seating furniture according to claim 1, wherein the base and the seat unit are attached to one another by a displacement unit, wherein said displacement unit can be moved in relation to the base and wherein the seat unit can be moved in relation to the displacement unit.

13. The item of seating furniture according to claim 12, wherein a first blocking system is provided by which in the storage state of the leg unit a displacement of the displacement unit in relation to the base is blocked, or a second blocking system is provided by which in a third use state a displacement of the leg unit in relation to the seat unit is blocked, wherein a uniform blocking system is provided, which fulfills a function of the first and of the second blocking system and which to that end comprises two stops which bear against one another both in the first and in a third use state.

14. The item of seating furniture according to claim 12, wherein the displacement unit can be displaced relative to the base starting from a base position along a movement path forwards.

15. The item of seating furniture according to claim 12, wherein for displacing the displacement unit in relation to the base:

a lever system is provided which comprises at least one movement lever which is pivotably coupled to the displacement unit and which is guided by at least two intermediate levers which are pivotably coupled to the base, or a slotted guide system is provided which comprises at least one slotted guide track in which at least one guide slider or guide roller is arranged.

16. The item of seating furniture according to claim 15, wherein at least one movement lever is coupled to the base by a first and a second intermediate lever, wherein a first distance between a pivot axis around which the first intermediate lever is coupled to the movement lever and a pivot axis around which the movement lever is pivotably attached to the displacement unit, a second distance between the pivot axis around which the first intermediate lever is coupled to the movement lever and a pivot axis around which the movement lever is pivotably attached to the second intermediate lever, and a third distance between the pivot axis around which the first intermediate lever is coupled to the movement lever and a pivot axis around which the first intermediate lever is pivotably attached to the base, differ from one another by at maximum 20%.

17. The item of seating furniture according to claim 1, wherein the item of seating furniture can be transferred between a first use state in which the leg unit is in the storage position thereof, a second use state in which the leg unit is in the use position thereof, and a third use state in which the leg unit is in the use position thereof, and in which the backrest unit has an orientation closer to the horizontal in relation to an orientation in the second use state.

18. The item of seating furniture according to claim 17, wherein the backrest unit can be pivoted around a backrest axis in relation to the seat unit, wherein the backrest axis can be displaced in relation to the base together with the seat unit, and a backrest guidance system is provided, by which the backrest unit is pivoted around the backrest axis depending on a relative position of the seat unit to the base or a relative position of the displacement unit to the base.

19. The item of seating furniture according to claim 18, wherein the backrest guidance system is configured in such a way that starting from the second use state the displacement unit and the seat unit together are displaced forwards in a direction of an orientation closer to the horizontal by pivoting the backrest.

20. The item of seating furniture according to claim 18, wherein the backrest guidance system comprises at least one slotted guide track, in which a guide slider or a guide roller is arranged.

21. The item of seating furniture according to claim 18, wherein the backrest guidance system comprises a control lever attached to the backrest unit eccentrically to the backrest axis, which lever on the one side is pivotably attached to the backrest unit and on the other side is pivotably attached to the base or a movement lever.

22. The item of seating furniture according to claim 1, wherein a spring device is provided, said spring device putting up a counterforce to a transfer of the leg unit from the use position in a direction of the storage position or a transfer of the leg unit from the storage position in a direction of the use position.

23. The item of seating furniture according to claim 22, wherein the spring device is arranged on subcomponents of the item of seating furniture between two coupling points, wherein said coupling points are arranged in such a manner that, during transfer of the leg support from the storage position into the use position, said coupling points are first of all spaced apart from each other and subsequently drawn nearer to each other.

24. A fitting system for an item of seating furniture, comprising: a base, a seat unit, a leg unit and a backrest support operationally coupled to movement of the seat unit relative to the base, the fitting system being designed for displacing the leg unit between a storage position, in which the leg unit is arranged under the seat unit, and a use position, in which the leg unit is arranged in front of the seat unit, wherein the fitting system has a movement mechanism designed for attaching to the base or the seat unit, on the one hand, and the leg unit, on the other hand, wherein the movement mechanism is designed for transferring the leg unit from the storage position, in which the leg unit is oriented substantially horizontally, into the use position, in which the leg unit is likewise oriented substantially horizontally, the movement mechanism has an intermediate support which is displaceable in relation to a seat-unit-side fastening section or a base-side fastening section by a pivoting guide, wherein the pivoting guide has at least one first pivot lever between the intermediate support and the seat-unit-side fastening section or the base-side fastening section of the base, the movement mechanism has a sliding guide with a sliding member, wherein the sliding member is guided in a translatory manner on the intermediate support, and wherein a leg-unit-side fastening section is attached to the sliding member, and a same side of the leg unit faces upwardly in both the storage position and the use position.

25. The fitting system according to claim 24, wherein the first pivot lever has a first pivot axis positionally fixed relative to the intermediate support and a second pivot axis positionally fixed relative to the seat unit or the base.

26. The item of seating furniture according to claim 1, wherein a same side of the leg support surface faces upwardly in both the storage position and the use position.

* * * * *

UNITED STATES PATENT AND TRADEMARK OFFICE

CERTIFICATE OF CORRECTION

PATENT NO. : 8,985,694 B2
APPLICATION NO. : 13/800802
DATED : March 24, 2015
INVENTOR(S) : Matthias Fischer It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 0 days.

This patent is subject to a terminal disclaimer.

Signed and Sealed this
Twenty-eighth Day of July, 2015

Michelle K. Lee

Michelle K. Lee
*Director of the United States Patent and Trademark Office*